US007420112B2

(12) United States Patent
Juszkiewicz et al.

(10) Patent No.: US 7,420,112 B2
(45) **Date of Patent: *Sep. 2, 2008**

(54) UNIVERSAL DIGITAL MEDIA COMMUNICATIONS AND CONTROL SYSTEM AND METHOD

(75) Inventors: Henry E. Juszkiewicz, Nashville, TN (US); Nathan W. Yeakel, Sunnyvale, CA (US); Shri Amit, Glendale, CA (US); Thomas L. Sherman, St. Paul, MN (US); Richard A. Frantz, Hatboro, PA (US); Jason S. Flaks, San Francisco, CA (US)

(73) Assignee: Gibson Guitar Corp., Nashville, TN (US)

( * ) Notice: Subject to any disclaimer, the term of this patent is extended or adjusted under 35 U.S.C. 154(b) by 785 days.

This patent is subject to a terminal disclaimer.

(21) Appl. No.: 10/694,710

(22) Filed: Oct. 28, 2003

(65) Prior Publication Data

US 2004/0133894 A1 Jul. 8, 2004

Related U.S. Application Data

(63) Continuation of application No. 09/995,405, filed on Nov. 27, 2001, now Pat. No. 6,686,530, which is a continuation-in-part of application No. 09/557,560, filed on Apr. 25, 2000, now Pat. No. 6,353,169.

(60) Provisional application No. 60/131,031, filed on Apr. 26, 1999, provisional application No. 60/156,003, filed on Sep. 23, 1999.

(51) Int. Cl.
*G10H 7/00* (2006.01)

(52) U.S. Cl. ..... 84/600; 84/645; 369/4; 370/420; 381/118

(58) Field of Classification Search ..... 84/600, 84/645; 369/4; 370/276, 420; 381/118
See application file for complete search history.

(56) References Cited

U.S. PATENT DOCUMENTS

| | | | | |
|---|---|---|---|---|
| 5,402,499 | A * | 3/1995 | Robison et al. | 381/119 |
| 5,487,067 | A * | 1/1996 | Matsushige | 370/460 |
| 5,615,380 | A * | 3/1997 | Hyatt | 345/520 |
| 5,768,350 | A * | 6/1998 | Venkatakrishnan | 379/93.08 |
| 5,917,835 | A * | 6/1999 | Barrett et al. | 714/755 |
| 5,933,430 | A * | 8/1999 | Osakabe et al. | 370/463 |
| 5,995,512 | A * | 11/1999 | Pogue, Jr. | 370/419 |
| 6,044,150 | A * | 3/2000 | Rigstad et al. | 379/387.02 |
| 6,353,174 | B1 * | 3/2002 | Schmidt et al. | 84/609 |
| 2006/0200253 | A1 * | 9/2006 | Hoffberg et al. | 700/19 |

FOREIGN PATENT DOCUMENTS

JP 07-049682 2/1995

* cited by examiner

*Primary Examiner*—Jeffrey Donels
(74) *Attorney, Agent, or Firm*—Stroock & Stroock & Lavan LLP

(57) ABSTRACT

A digital media communications and control system includes a plurality of audio devices each of which includes a device interface module for communication of digital media data and control data from at least one of the devices to at least one other of the devices. A universal data link is operatively connected to each of the device interface modules. The device interface modules and universal data links are operative in combination to connect the devices together in the system and provide full duplex communication of the digital media data and control data between the devices.

14 Claims, 5 Drawing Sheets

UNIVERSAL DIGITAL MEDIA COMMUNICATIONS AND CONTROL SYSTEM AND METHOD

Be it known that we, Henry E. Juszkiewicz, Nathan Yeakel, Shri Amit, Thomas L. Sherman, Richard A. Frantz, and Jason S. Flaks have invented a "Universal Digital Media Communications and Control System and Method."

This application is a continuation of and claims benefit of U.S. patent application Ser. No. 09/995,405 filed Nov. 27, 2001 now U.S. Pat. No. 6,686,530, entitled "Universal Digital Media Communications and Control System and Method" which is a continuation-in-part of and claims benefit of U.S. patent application Ser. No. 09/557,560 filed Apr. 25, 2000, now U.S. Pat. No. 6,353,169 issued Mar. 5, 2002, entitled "Universal Communications and Control System For Amplified Musical Instruments", which claims benefit of our previously filed provisional applications Ser. No. 60/131,031, filed Apr. 26, 1999, entitled "Universal Communications and Control System For Amplified Musical Instrument", and Ser. No. 60/156,003 filed Sep. 23, 1999, entitled "Universal Communications and Control System For Amplified Musical Instrument".

BACKGROUND OF THE INVENTION

This invention pertains to systems for enabling the communication of digital media signals and data between a media source device, such as a musical instrument, and electronic components needed to control and re-produce sounds generated by that source device. More specifically, this invention relates to a system and method that facilitates the interconnection of one or more diverse musical instruments and related audio components on a universal network for purposes of communication of audio signals and signals to identify and control the devices.

The generation, transmission, amplification and control of audio and other media signals and devices involve diverse yet interrelated technologies that are changing rapidly. The development and implementation of high bandwidth digital communication technologies and distribution systems is significantly affecting all media industries, from book publishing to television/video broadcasting. Products, systems, and services that affect the sense of sight or sound are converging in the use of common technologies and distribution pipelines. This has a profound effect, not only on the nature of the products that are produced, but on the sales channels and the methods of producing content for those products.

Current examples of the convergence of audio and digital technologies are the arrival and consumer acceptance of the MPEG-3 digital music format, the inexpensive recordable CD (e.g., the "MiniDisc"), and the high bandwidth Internet. However, the markets for technology-driven products are not served by implementation of multiple technical standards. Typically, a new technology begins in its early phase with multiple standards, which in many cases are vigorously debated and disputed among various advocates for the different standards. In most technology-driven industries that prosper, a single standard historically is universally adopted by members of that industry.

Similarly, there is a need for a universally accepted standard for digital communication of audio and video content. Because of the overwhelming acceptance of the Internet and its TCP/IP protocol, coupled with a substantial pre-existing infrastructure of network hardware, software, and know-how, a universal standard for digital audio/video communication and control should revolve around this well-known TCP/IP and Internet technology.

The weakness of the existing audio hardware market is in its application of digital electronic technologies. Today's musicians can record and process multiple-tracks of high quality sound on their computers but are forced to plug into boxes with 1950's era analog circuits. For example, the original challenge in the guitar musical instrument industry was to make the guitar louder. The circuits of the day distorted the sound of the instrument, but did accomplish their task. With time, these distortions became desirable tones, and became the basis of competition.

Guitar players and other musicians are very interested in sound modification. Digital technology allows musicians to create an infinite variety of sound modifications and enhancements. Musicians in small clubs typically have a veritable arsenal of pedal boxes, reverb effects, wires, guitars and the like. They generally have a rack of effects boxes and an antiquated amplifier positioned somewhere where the sound distribution is generally not optimal because the amplifier is essentially a point source. Because of this lack of accurate sound placement, the sound technician is constantly struggling to integrate the guitar player into the overall sound spectrum, so as to please the rest of the band as well as the audience who would love to hear the entire ensemble. Current solutions for this issue include positioning a microphone in front of a speaker and then mixing the audio from the microphone with the house sound.

Technology has made some progress along a digital audio path. For example, there are prior art guitar processors and digital amplifiers that use digital signal processing (DSP) to allow a single guitar to emulate a variety of different guitar sounds, amplifier types, and other sound modifications such as reverb and delay. To achieve the same variety of sounds and variations without using DSP technology, a musician would have to buy several guitars, several different amplifiers, and at least one, if not more than one, accessory electronic box.

All existing instruments, if they use a transducer of any kind, output the sound information as an analog signal. This analog signal varies in output level and impedance, is subject to capacitance and other environmental distortions, and can be subject to ground loops and other kinds of electronic noise. After being degraded in such fashion by the environment, the analog signal is often digitized at some point, with the digitized signal including the noise component. Although existing digital audio technologies show promise, it is clear that the audio equipment and musical instrument industries would benefit from a system and method where all audio signals are digital at inception or at the earliest possible point in the signal chain.

At present, there are multiple digital interconnection specifications, including AES/EBU, S/PDIF, the ADAT "Light Pipe" and IEEE 1394 "Firewire". However, none of these standards or specifications is physically appropriate for the unique requirements of live music performance. In addition, clocking, synchronization, and jitter/latency management are large problems with many of these existing digital options.

Different segments of the music market have experimented in digital audio. Some segments have completely embraced it, but there is no appropriate scalable standard. Clearly, digital components exist, but these are designed to function as stand alone digital devices. Correspondingly, many manufacturers have chosen to make their small portion of the product world digital but rely mainly on traditional analog I/O to connect to the rest of the world. This may solve the local problem for the specific product in question, but does little to resolve the greater system-oriented issues that arise as the number of interconnected devices grows. In addition, the small sound degradation caused by an analog-to-digital and digital-to-analog transformation in each "box" combines to produce non-optimal sound quality. Finally, the cost, power and size inefficiency related to having each component in a chain converting back and forth to digital begs for a universal, end-to-end digital solution.

Another basic yet important part of the problem is that live musicians need a single cable that is long, locally repairable, and simple to install and use. In addition, it is highly desirable to support multiple audio channels on a single cable, as setups often scale out of control with current multiple cable solutions. Providing low current, DC power through the cable for the active circuits used in digital instruments would be preferable to the use of batteries which many conventional instruments depend on.

Based on the technology trends and patterns that have already been established, a digital guitar will emerge with the transducers (pick-ups) feeding a high bandwidth digital signal. This advance will remove many detrimental aspects of the analog technology it will replace, including noise, inconsistent tonal response from time to time, and loss of fidelity with a need for subsequent signal processing. The introduction of digital technology from the instrument will allow the entire signal path and the equipment associated with the signal path to be digital. Unfortunately, there is no system available to interconnect multiple musical instruments and associated audio components so that they can communicate with each other and be controlled entirely in the digital domain, using a universal interface and communications protocol.

In summary, despite dramatic advances in technology, real-time high-fidelity digital audio has yet to permeate both production and live performance. Increasing demand has motivated little effort to apply modern network technology towards producing superior quality real-time audio devices, at low prices. A small number of isolated digital systems do exist but they rely on archaic analog interfaces to connect with other devices. An increasing demand for more interconnected devices has resulted in diminished sound quality in these systems, caused by repeated analog-to-digital and digital-to-analog conversions. Additionally, this conversion requires capability that often results in prohibitive size and power requirements.

Many of the existing systems are difficult to install, lack flexible reconfiguration capabilities, and do not take advantage of intuitive user-friendly hardware and software interfaces. Existing digital interconnection specifications do not satisfy the unique requirements of live audio performances, particularly in the areas of clocking, distance synchronization, and jitter/latency management.

Thus, there remains a compelling need in the audio industry for an open architecture digital interconnect that would allow audio products from different vendors (musical instruments, processors, amplifiers, recording and mixing devices, etc.), to seamlessly communicate.

SUMMARY OF THE INVENTION

A primary object of the present invention is to adapt digital technology invented for computer network products to audio equipment, and to develop an interconnect that is reliable over long distances, locally repairable, trivial to install, and simple to use.

Another object of the invention is to provide a musical device interconnect and communications system and method that is capable of supporting multiple audio channels of advanced fidelity audio.

A further object of the invention is to implement a system that enables installations to scale beyond the capacity of existing multiple cable solutions and meet the requirements of permanent installations such as live venues and recording studios.

Yet another object of the present invention is to provide power for digital instruments thereby eliminating the need for batteries.

These and other objects must be accomplished by augmenting and not diminishing the acoustic, electric, or physical characteristics of musical instruments.

Accordingly, the system and method of the present invention provides the audio industry with an Open Architecture digital interconnect that allows audio products from different vendors (musical instruments, processors, amplifiers, recording and mixing devices, etc.), to seamlessly communicate. For convenience, the system of the present invention will sometimes be referred herein as the Media Accelerated Global Information Carrier (or MAGIC). MAGIC™ is a trademark of Gibson Guitar Corp., the assignee of the present invention. MAGIC overcomes the limitations of point-to-point solutions by providing inexpensive yet seamless enhanced digital sonic fidelity. The MAGIC system provides the ability to create audio networks appropriate for use in a wide variety of environments ranging from professional audio to home music installations. A MAGIC system provides a single cable solution that is trivial to install, requires little or no maintenance, and offers a data link layer that supports a simple yet sophisticated protocol, capable of offering a superior user experience.

A MAGIC system provides up to 32 channels of 32-bit bi-directional high-fidelity audio with sample rates up to 192 kHz. Data and control can be transported 30 to 30,000 times faster than MIDI. Added cable features include power for instruments, automatic clocking, and network synchronization.

The system is scalable to provide, for example, 32 channels of 48 kHz, 24 bit audio, 16 channels of 96 kHz, 24 bit audio, or 8 channels of 192 kHz, 24 or 32 bit audio, with an embedded command layer.

The system of this invention includes the MAGIC data link, a high-speed network connection for communication of digital audio data between two MAGIC devices. The system and method of the invention further includes definitions and description of the characteristics of individual MAGIC devices as well as MAGIC system configuration and control protocols.

The MAGIC data link is a high-speed connection transmitting full-duplex digital audio signals, control signals, and device enumeration and/or individual user data between two interconnected MAGIC devices. Self-clocking data are grouped into frames that are continuously transmitted between MAGIC devices at the current sample rate.

Flexible packing of digital audio data within a frame allows a tradeoff between sample rate and channel capacity to optimize the fit and interface for MAGIC devices having diverse characteristics. A Control data field provides for MAGIC system configuration, device identification, control, and status. User data fields are provided for transmitting non-audio data between MAGIC devices.

A MAGIC system will typically include multiple "MAGIC devices". A MAGIC device is any device equipped with a MAGIC Link that allows it to exchange bi-directional, fixed-length data and control, at a determined network sample rate. A MAGIC device can be an instrument having a sound transducer such as a guitar, microphone, or speaker. A MAGIC device can also be an intelligent device that provides connections and power for multiple MAGIC devices, and is capable of, and responsible for, configuring the MAGIC system. A MAGIC device controller may also include upstream and downstream connections (in hub and spoke or daisy chain configurations) to other devices for increased instrument connectivity.

Data link electronics and associated cabling and connectors are designed for reliable use in harsh environments. "Hot-plugging" of MAGIC devices is supported by the system.

Accordingly, a Universal Digital Media Communications and Control System is provided that includes the following novel features:

(1) The Control data for each device includes a "Friendly naming" scheme using a Device ID so that: (a) there is an automatic configuration by, and synchronization to, the system by the identifying device; (b) the use of a "Friendly name" allows the user to name his device on the system; (c) the "device name" resides in the device, not in a data base; and (d) the device ID is available when the device is plugged into a 'foreign' MAGIC system.

(2) A bidirectional device interface is provided that adds "response" to the existing instrument stimulus to create a full duplex instrument that is able to display and react to other devices in the system.

(3) The system topology allows for nodal connection of resources so that instruments and control devices plug in to create the desired system complexity and allowing for simple system enhancement by plugging in a new device with the desired features.

(4) The system implements dynamic resource allocation, including: (a) routing of audio and control signals "on the fly"; (b) audio nodes can be 'moved' at will; and (c) special effects devices can be shared with out physically moving or connecting them.

(5) Logical connections are made to the system so that a device can be physically connected into the system through any available connector, e.g., a guitar does not have to be directly plugged into the guitar amplifier.

(6) The system has a multi-layered protocol that supports many different physical transport media and allows for simple expansion of both the number of audio channels and the data bandwidth.

(7) There can be a familiar looking (to the user) point to point connection of devices, or a "star" network (analogous to a "breakout box") configuration for multiple devices, thereby simplifying the user experience.

(8) Phantom power for instrument electronics is delivered over the MAGIC data link.

(9) The system can take advantage of conventional network hardware, e.g., one embodiment of a MAGIC system is implemented over a 100-megabit Ethernet physical layer using standard Category 5 (CAT5) cable and RJ-45 connectors.

Thus, the present invention is the first low-cost digital interconnection system based on a universal standard that is appropriate for use in the live, professional, studio and home music performance environments. The MAGIC technology of this system can be quickly adapted for use in musical instruments, processors, amplifiers, recording devices, and mixing devices.

The system of this invention overcomes the limitations and performance liabilities inherent in current "point solution" digital interfaces and creates a completely digital system that offers enhanced sonic fidelity, simplified setup and usage while providing new levels of control and reliability.

MAGIC enables musical instruments and supporting devices such as amplifiers, mixers, and effect boxes from different vendors to digitally inter-operate in an open-architecture infrastructure. MAGIC creates a single-cable system with 32 audio channels both to and from the instrument and also includes high-resolution control and data channels.

This modular, scalable system overcomes the limits and liabilities inherent in current "point solution" digital interfaces. MAGIC creates a completely digital system that offers enhanced sonic fidelity, simplified setup and usage while providing new levels of control and reliability. The MAGIC protocol is independent of the physical layer itself. MAGIC can be delivered over any deterministic wire-, wireless- or optical-based digital transport mechanism. The MAGIC system and method of this invention is unique in that it takes the non-realtime environment of Ethernet, and transforms it into a synchronous, real-time audio transport. This is achieved by a set topology rules that determine that there is always a single master clock, and signaling at a fixed rate. This sync is propagated across the network, assuring all services are in phase.

DETAILED DESCRIPTION OF THE PREFERRED EMBODIMENTS

System Overview

A MAGIC-compliant device is defined as one equipped with a MAGIC Link through which it can exchange real-time, bi-directional, fixed-length data and control information, at a determined network sample rate. Unless specified otherwise, the term "device" is to be understood as referring to a MAGIC-compliant device. A MAGIC system is a network of devices connected via a modular, bi-directional, high-speed interconnect which allows them to exchange audio and control information at a fixed network sample rate.

MAGIC networks can be arranged in different topologies: (a) a daisy chain network where devices are connected together to form a single chain; (b) a star network where several daisy chain networks are connected together using a routing hub; and (c) an uplink network topology where at least two switching hubs that allow data from several MAGIC Links to be multiplexed onto a single cable.

Figure 1:
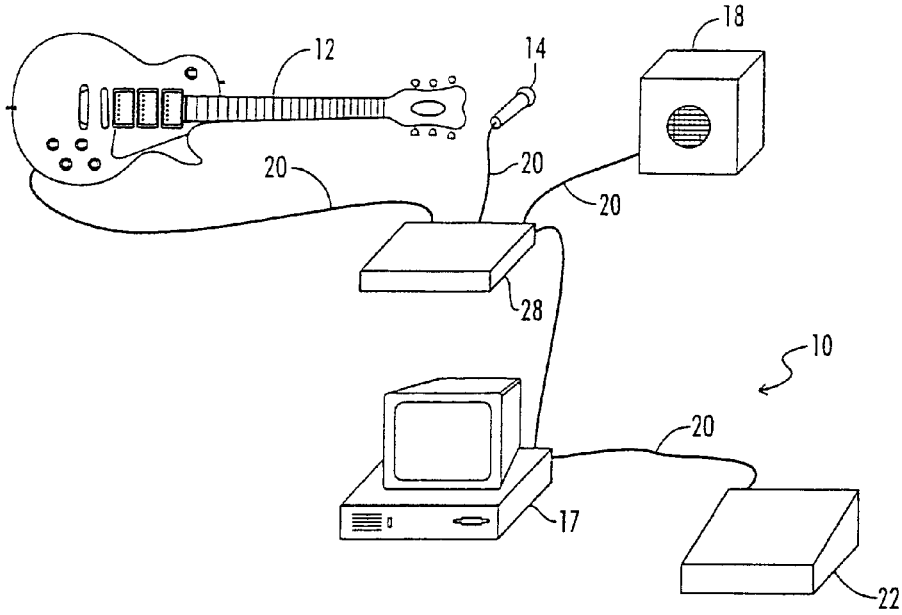
FIG. 1 is a block diagram of the system of this invention showing a typical arrangement that interconnects instrument devices with various control devices.
Figure 2:
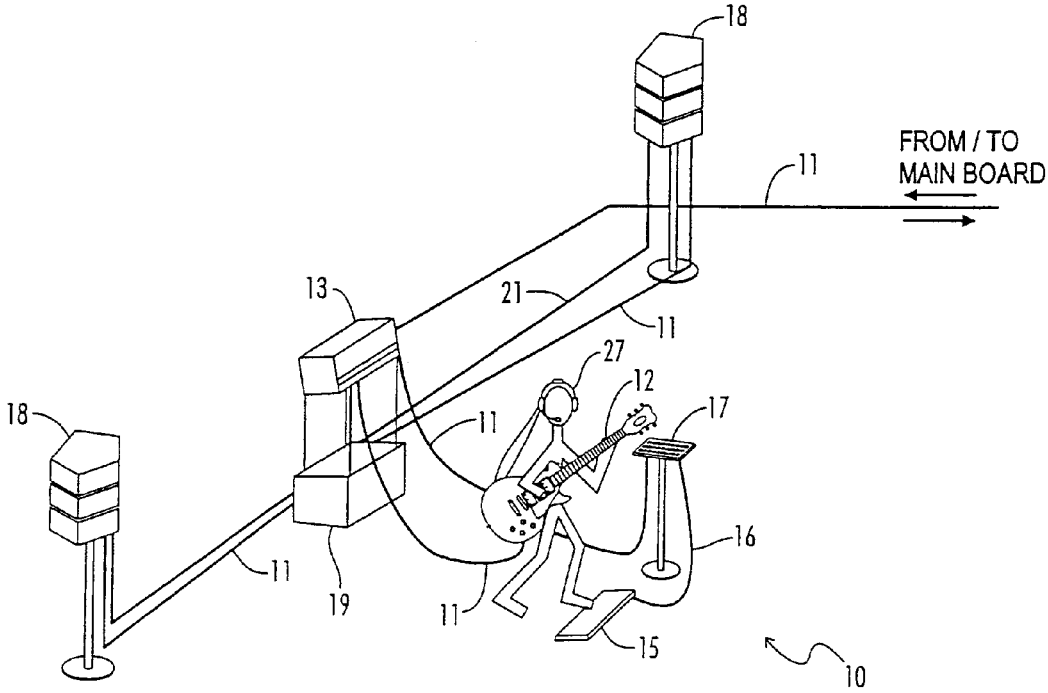
FIG. 2 is a schematic diagram of an embodiment of the system of this invention showing a physical implementation and interconnection of devices in an on-stage performance audio environment.

As shown generally in FIGS. 1 and 2, the topology of one embodiment of a MAGIC system 10 of this invention is characterized by a modular, daisy chained bi-directional digital interconnection of musical instrument devices, processing devices, amplifiers and/or recording systems. Each device has a data link connection to one or more other devices. Thus, the system 10 is comprised of instrument and control devices that are interconnected by MAGIC data links.

For example, as shown in FIG. 2, a guitar setup in a MAGIC system 10 may include a guitar 12, an amplifier 13, and a control pedal 15. The guitar 12 may be directly connected to the amplifier 13 through a system data link cable 11. The foot control 15 may be connected through a USB cable 16 to a control computer 17, with the control computer 17 also connected to the amplifier 13 through another link cable 11. Alternatively, the guitar 12 may be directly connected to the control pedal 15, which is in turn connected to the amplifier 13. The guitar 12 contains a system device module 23 (FIG. 4) so that the guitar 12 can generate digital audio data as well as send control data from one or more of its several internal control devices such as a pickup selector, volume control knob, or tone control. The control pedal 15 will generate control data, and relay the audio data sent from the guitar 12. The amplifier 13 will act as a receiver for any control or audio data sent by the guitar or volume pedal. Because the system 10 provides bi-directional communication of audio and control data, it is feasible for amplifier 13 to send control messages or audio back to the guitar 12.

Not unlike common networking protocols, the MAGIC system and method of this invention uses a protocol that is stacked into three distinct layers. From the lowest to highest, they are:

(1) Physical Layer, consisting of the mechanical and electrical specifications required to form the physical network. This layer is compatible with the IEEE 802.3 Ethernet physical layer. The Physical Layer is sometimes referred to herein as the "physical interface."

(2) Data Link Layer, as defined by the IEEE 802.3 Ethernet protocol. It views bits transported by the Physical Layer as defined sequences called frames that can be transported across any standard Ethernet-compatible network. The Data Link Layer is sometimes referred to herein as the "data link interface."

(3) MAGIC Application Layer which uses the frames transported by the Data Link Layer to encapsulate MAGIC-specific information into packets that allow MAGIC devices to exchange real-time bi-directional audio and control data.

Physical Interface

The current physical interface is based on a conventional 100 megabit Ethernet physical layer, standard CAT5 cables, and RJ-45 connectors.

Other possible physical interfaces include a high-speed multi-link optical interface, wireless, and a physical layer interface based on a gigabit Ethernet physical layer. The wireless applications of a MAGIC system are dependent on the current capabilities and bit density of available technology. The high bandwidth optical interfaces are ideal for transporting large numbers of MAGIC channels over long distances. This is very useful in large arenas where the mixing console or amplifiers may be hundreds of feet from the stage and require an enormous number of audio channels. Phantom power is not available for optical-based systems.

Electrical Interface

The electrical interface is based on a 4b/5b data-encoding scheme, which is then scrambled to eliminate RF 'hot spots', thereby reducing emissions. Of the eight conductors in a standard CAT5 cable, only four are used for data transport. MaGIC uses the four unused conductors to supply phantom power for instruments that can operate with limited power. Guitars, drum transducers, and microphones are examples of such devices. Preferably, the MAGIC link supplies at least 500 mA of DC current to the instrument. The Link Host insures that the MAGIC Link power is safe both to the user and to the equipment. Current limiting is done so that the system will become operational after a short circuit has been corrected. Fuses that need replacement when triggered are not recommended.

The MAGIC protocol is designed to allow the use of many different physical transport layers. There are a few important rules that must be followed when selecting a possible transport layer for MAGIC. First, the transport must have very low latency. MAGIC is a real-time digital link. Latency must not only be very low, on the order of a few hundred microseconds, but must also be deterministic. Second, the physical interface must be robust enough to function properly in a live performance environment. A live environment may include high voltage/current cables running near or bundled with a link cable. For a link to be acceptable it must function properly in this harsh environment.

Data Link Layer

Data is transmitted between MAGIC devices in the form of discrete, fixed-size packets or frames at a synchronous rate, preferably using the IEEE 802.3 Ethernet standard. The packet contains networking headers, audio/data, and control information. Each frame is 55 words long and contains the standard Start of Frame, Source and Destination MAC Addresses, Length, words reserved for networking headers, a fixed size data payload, and a CRC field.

All data on a MAGIC network must be Big Endian. Any Little Endian device must accordingly swap the necessary bytes before sending and before processing newly received information.

Application Layer

The Application Layer encapsulates a MAGIC packet in the payload field of the Data Link Layer frame. Each packet consists of thirty-two, 32-bit data slots as 16, 24, 28 or 32 bits of PCM audio. Specific compressed data formats are also supported and can be identified. Each individual audio pipe can be reassigned as 32-bit data if desired. The packet also contains configuration flags and control information for processes like network enumeration, sample rate modification, or parameter control. Other types of control protocols such as MIDI can also be supported.

System Timing Master

In order for all devices within the MAGIC system to be processing data in-phase with one another, there must be a single source of synchronization. This source is called the System Timing Master (STM). The STM is selected automatically on the basis of preset system rules and is responsible for using an enumeration protocol to assign dynamic addresses to all devices available on the network. The STM can be any non-instrument device and may be selected during the system configuration process. If no device is configured as the STM one will be selected automatically based on system hierarchy. In a situation where multiple devices are hooked up as a daisy chain, three rules are presented which allows for an STM to automatically be selected. The STM is responsible for assigning dynamic addresses (enumerating) the devices available on the network.

The MAGIC packet timing is synchronous to the audio sample rate of the system. This sample, or packet, timing is either locally generated, in the case of the STM, or recovered and regenerated in a slave device. The transport clock is asynchronous to the sample clock and is only used by the physical layer transport mechanism. In a preferred embodiment, the default MAGIC packet timing is 48 kHz with an acceptable tolerance of 80 picoseconds. This timing is locally generated in the case of the STM, and recovered and regenerated in the case of a slave device. The Ethernet signaling rate is asynchronous with the rate at which frames are transmitted. The transport clock is asynchronous to the sample clock and is only used by the physical layer transport mechanism.

Figure 4:
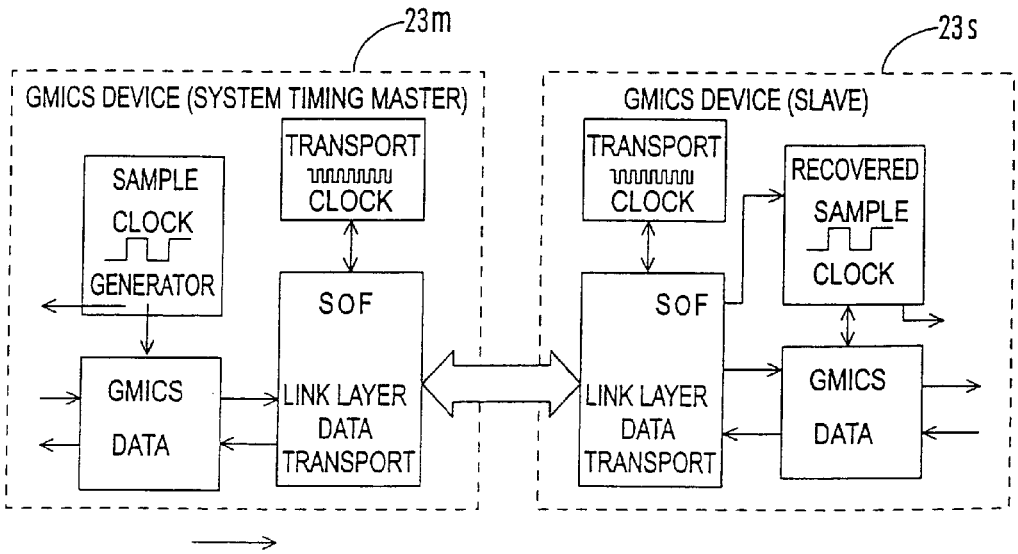
FIG. 4 is a block diagram showing two device interface modules used in instrument or control devices connected to in a MAGIC system, with one device interface module configured as a system timing master and a second device interface module configured as a slave.

FIG. 4 is a simplified block diagram of a device interface module including a MAGIC STM 23*m* connected to a MAGIC system timing slave device 23*s*. The slave device 23*s* uses only the recovered and regenerated sample clock for encoding/decoding the MAGIC data packets.

Control Protocol

Control information is an essential factor in instrument functionality. An intricate native control protocol is used in a MAGIC system. The MAGIC control protocol provides a generic framework that allows any component on a device that can generate a parameter to control an arbitrary component located on another other device. The MAGIC control protocol is based on a friendly-naming system that requires devices to name their components in a certain format. This eliminates the need for predefinition of parameter and controller messages as is common in other protocols such as MIDI. Non-MAGIC control messages can also be exchanged by encapsulating them in a MAGIC packet.

System control messages allow devices to query the network for certain friendly-names and dynamically agreed on what is referred to as a Control Link (CL). Once established, a CL allows one device to exchange control messages with any other one on the network. Non-MAGIC control messages, like MIDI, can also be exchanged by encapsulating them in a MAGIC packet.

MAGIC control revolves around the devices which are units of control. Each control packets contains source and destination address of the devices as well as the specific components on those devices between which the message is being exchanged. Device addresses are assigned by the STM during enumeration. Component addresses are assigned by each device during device initialization. This alleviates the necessity to predefine parameter and controller messages as is done in MIDI systems. Devices can query for other device addresses and associated friendly names by using system control messages. This allows for complete control while still supporting a non-technical, user-friendly interface.

Control message from other specifications can be encapsulated in the 32-bit data word. MIDI is one example of a defined alternate control type.

The MAGIC Connector

MAGIC Link

Figure 5:
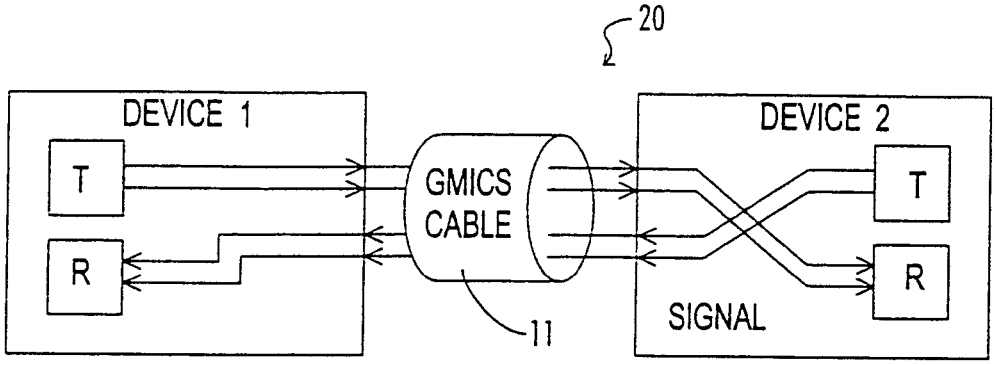
FIG. 5 is a schematic diagram of a crossover connection between linked devices in a MAGIC system so that data transmitted by a device is received by another device.

The 100-megabit MAGIC data link uses the industry standard RJ-45 connector and Category 5 cable as shown in FIG. 5. Preferably, the cables and connectors will meet all requirements set forth in the IEEE802.3 specification for 100BASE-TX use.

MAGIC Signals & Connector Pin Assignment

MAGIC uses a standard CAT5 cable for device interconnection. A single cable contains four twisted pairs. Two pairs are used for data transport as in a 100BASE-TX network connection. The remaining two pairs are used for power.

Standard CAT5 patch cords are wired one-to-one. This means that each conductor is connected to the same pin on both connectors. As shown in FIG. 5, a crossover function must be performed within one of the connected devices. This allows data transmitted by one device to be received by another.

Figure 6:
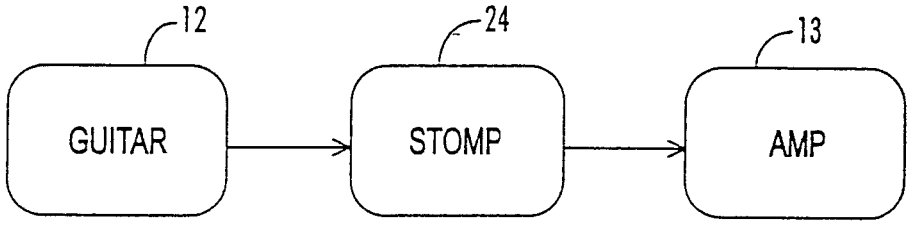
FIG. 6 is a block diagram showing typical connections of guitar, effects box, and amplifier devices in a MAGIC system.
Figure 7:
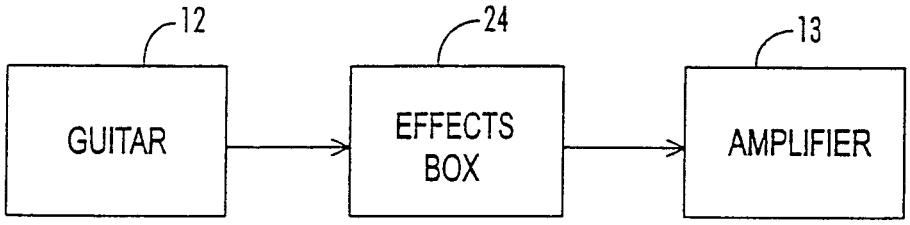
FIG. 7 is a block diagram showing the direction of dominant data flow in a simple MAGIC system.

Due to this relationship, a MAGIC system has two different connector or port configurations for MAGIC devices. The diagram of FIG. 6 shows a guitar 12, and effect box 24, and an amplifier 13. There are two preferred port configurations used in the system, labeled port A and port B in the table below. All instruments must use the Port A configuration. Amplifiers and other devices use port B for inputs from instruments and port A for output to other devices. MAGIC connections are made with CAT5 approved RJ-45 plugs and jacks.

The following table lists the signals and connector pin numbers for both the A & B Port configurations.

| Signal Name | Port A pin number | Port B pin number |
|---|---|---|
| Transmit Data (TX)+ | 1 | 3 |
| Transmit Data (TX)− | 2 | 6 |
| Receive Data (RX)+ | 3 | 1 |
| Receive Data (RX)− | 6 | 2 |
| Power Ground | 4 | 4 |
| Power Ground | 5 | 5 |
| Voltage+ | 7 | 7 |
| Voltage+ | 8 | 8 |

The pin number assignments are chosen to insure that signals are transported over twisted pairs. The Transmit and Receive signals use the same pins that a computer's network interface card (NIC) does. The two pair of wires not used in standard 100BASE-TX networks, carry phantom power. This connector pin assignment is chosen to reduce the possibility of damage if a MAGIC device is directly plugged into a computer network connector.

An important feature of MAGIC is the automatic determination of the System Timing Master device. To make that possible, the system imposes a maximum of one A-port per device. There is however, no limit on the number of B-ports a device can have.

Dominant Data Flow

While it is true that the MAGIC protocol is symmetrical and bi-directional, there is almost always a dominant direction to the flow of data due to the nature of audio devices. Audio devices can be classified into producers, processors, relays, or consumers. Quite naturally, the dominant direction tends to be from the producers through processors and/or relays onto consumers. In a simple MAGIC system consisting of a musical instrument, an effects box, and an amplifier, the dominant data direction is from the instrument to the effects box then on to the amplifier, as shown in FIG. 8.

Figure 8:
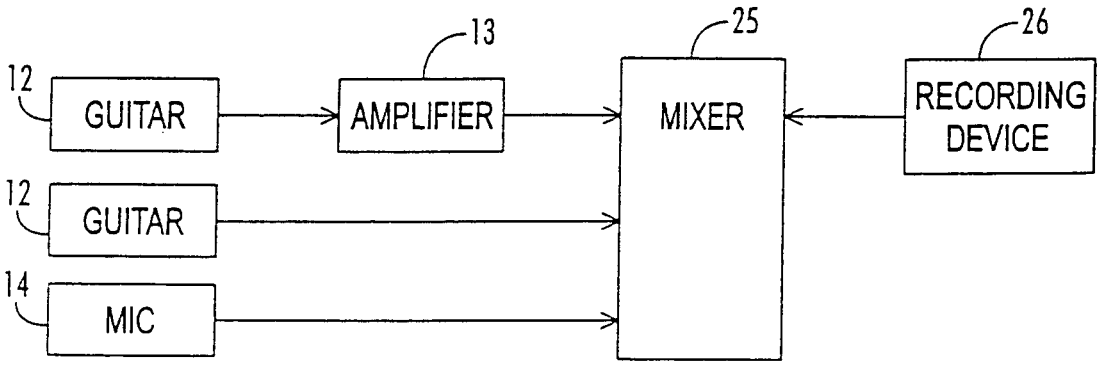
FIG. 8 is a block diagram showing the direction of dominant data flow in a MAGIC system that includes a recording device.
Figure 9:
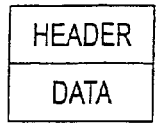
FIG. 9 is a high-level view of a typical MAGIC data packet format.
Figure 10A:
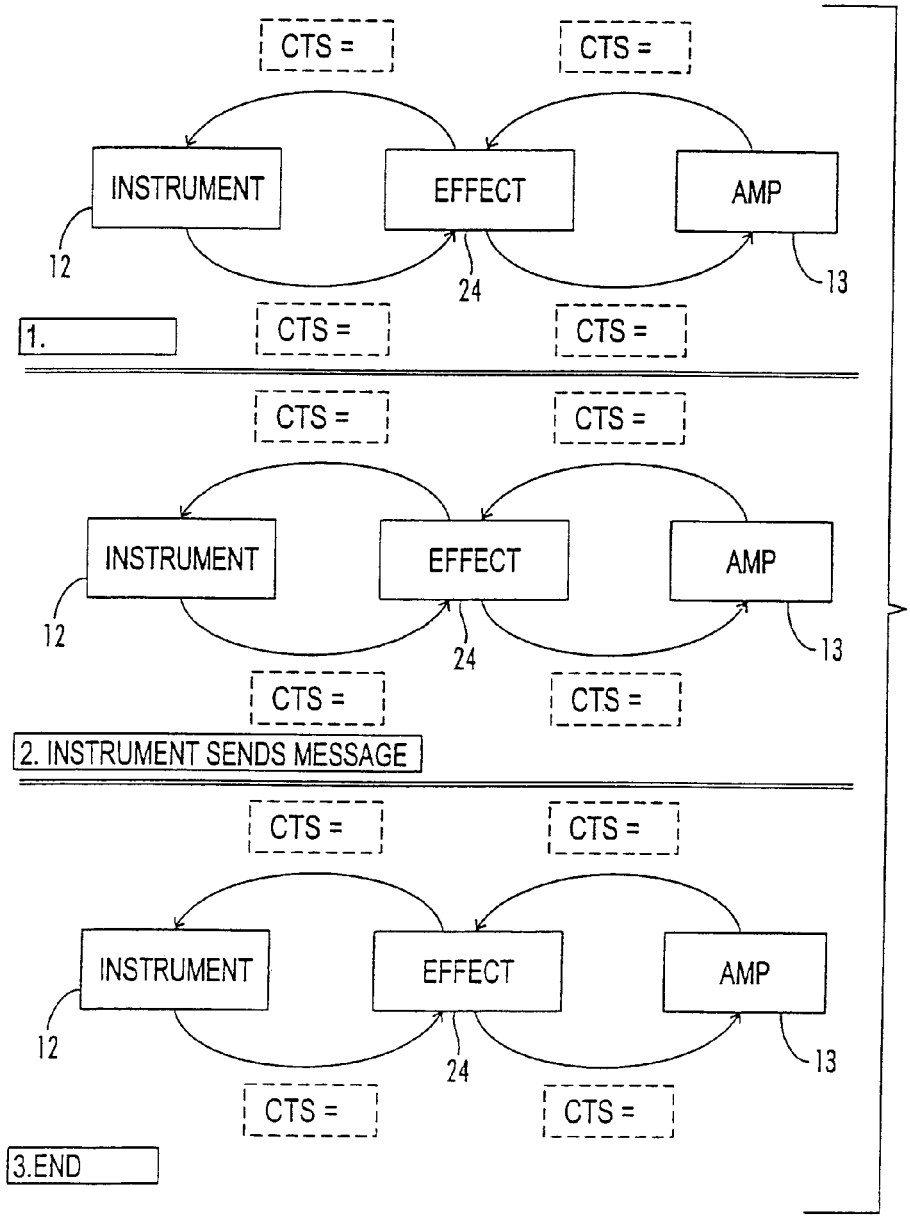
FIGS. 10(*a*) and 10(*b*) are block diagrams illustrating control message flow scenarios among linked devices in a MAGIC system.
Figure 10B:
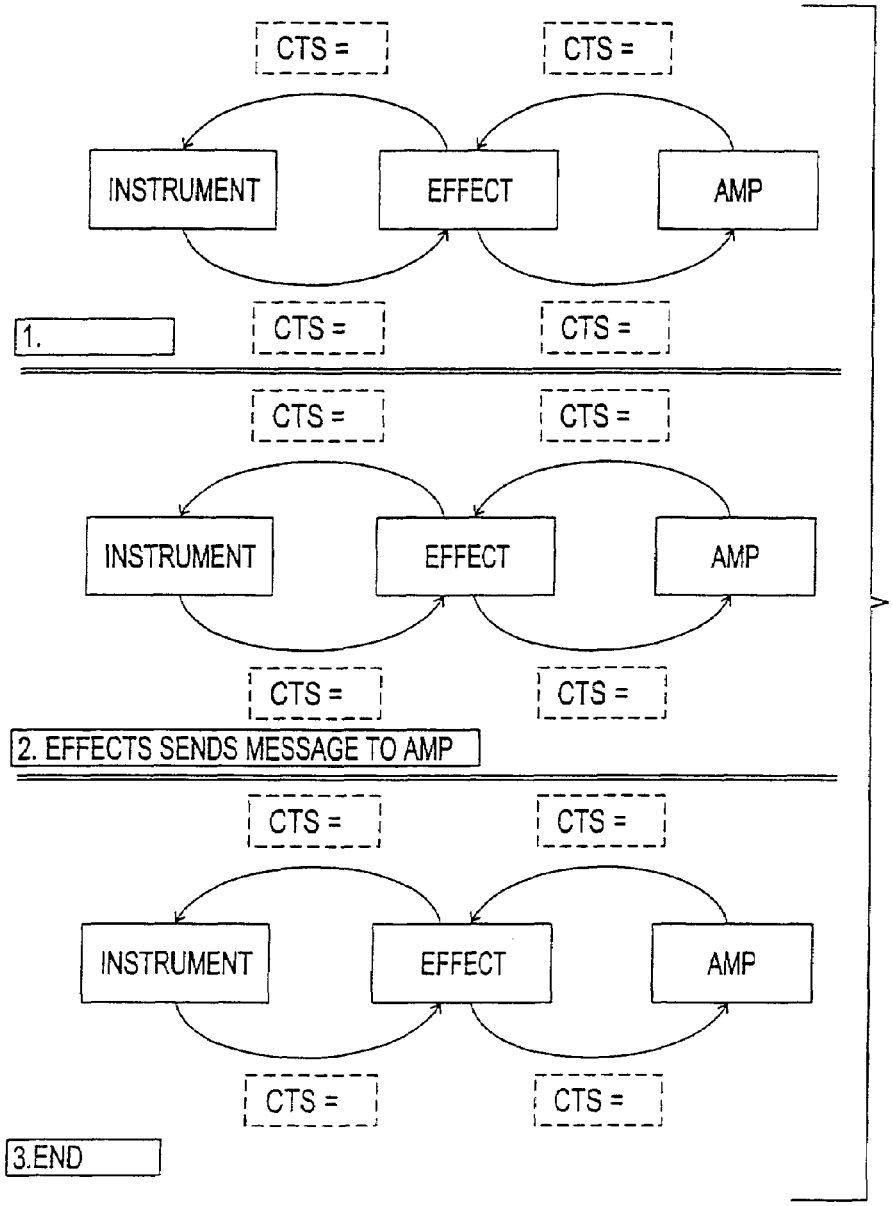

In the second example of FIG. 8, three instruments (two guitars 12 and a microphone 14) are connected to through an amplifier 13 to a mixer 25 that is connected to a recording device 26. The recording device 26 does not have a dominant direction of data flow. While recording, the dominant direction is to the recorder 26 while it is from the recorder 26 during playback. For clarity in describing a MAGIC system, a recording device 26 will always be treated as an instrument in that the dominant data flows from the recorder.

The MAGIC Cable

MAGIC Interconnect Cable

MAGIC devices use industry standard computer networking cables for both signal and power. The MaGIC link is designed to use standard CAT5 patch cables of lengths up to 152.4 meters. Acceptable CAT5 cables must include all four twisted pairs (8 wires). Each conductor must consist of stranded wire and be 24 gauge or larger. The cable and connectors must meet all requirements for 100BASE-TX network usage. It should be noted that MAGIC uses the standard computer-to-hub CAT 5 patch cords, not the special computer-to-computer cables. The MAGIC cable is always wired as a one-to-one assembly. Cables must be connected between A and B ports, not A to A or B to B. Devices used in a MICS system should include a mechanism to notify the user of a proper connection. This would allow the user to easily detect and rectify incorrectly connected cables.

Special Considerations

There are special considerations to be made when selecting CAT5 cables for use in MaGIC networks. . These special requirements are due to the fact that MAGIC enabled devices are used in live performance applications, which place additional requirements on the cable, compared to standard office network installations.

One consideration would be to use a cable that includes protection for the locking clip of the RJ-45 connectors. Without this protection the locking clips can be over-stressed and broken. Once the locking clip is broken the connector will not stay properly seated in the mating jack.

A second consideration is the flexibility and feel of the cable itself. The selected cable should have good flexibility and be constructed such that it will withstand the normal abuse expected during live performances. Unlike most network installations the connecting cable in a MAGIC system will experience much twisting and turning throughout its life. For these reasons, stranded CAT5 cable is required for MAGIC applications. Solid wire CAT5 will function correctly initially, but will fail more often. A MAGIC system should never be wired in such a fashion that any loops exist.

Also, the pin assignments described with reference to this embodiment are exemplary only and may be varied depending on the choice of cable and connector.

System Electrical Detail

MAGIC Physical Layer

IEEE802.3 Compatibility

The common MAGIC data link physical layer is based on the 100BASE-TX Ethernet physical layer as described in the IEEE802.3 Specification. It is UDP compatible and is similar to UDP in that it has no re-transmit command, handshaking protocol, or guaranteed delivery. In order to maximize bandwidth for providing live synchronous audio, each individual link occupies the entire bandwidth in full duplex mode of discrete 100baseT link.

MAGIC MaGIC/IEEE802.3 Differences

The MAGIC data link Physical Layer is always operated at 100 megabits per second in the full duplex mode. Much of the functionality of a standard 10/100 megabit physical layer implementation is dedicated to detecting and switching modes and is not required for the MAGIC system.

Timing Parameters

Sample Clock Recovery

Recovering the sample clock from any digital link is of critical concern to the designer. In order to ensure that all devices are synchronously processing data, it is important that the recovered sample clock is based on the incoming sample rate. This frame rate is independent of the physical medium data transmission rate.

With the exception of devices with sample rate conversion capabilities, the STM should supply sample timing for other devices on the network with a maximum frame-to-frame jitter of 80 picoseconds. All other devices must generate their outgoing frames in-phase with the stream of incoming frames. The frame-to-frame jitter of the outbound frames from non-STM devices must not exceed 160 nanoseconds. This is not a measure of accumulated jitter.

It is imperative that the recovered sample clock is locked to the incoming sample rate, and it is also desirable that all devices operate in phase with each other. The sample clock is based on the phase of the incoming signal, and, if need be, can be multiplied up to the system sample rate. This will insure that all devices are processing data in a synchronous manner.

Latency

In order for MAGIC to function as a real-time digital link, audio latency must be contained to a low deterministic minimum. There are three sources of latency in a MAGIC network:

1. Physical Layer: For a 100baseT physical layer this is usually in the range of 10-40 microseconds.
2. Digital/Analog conversion: Analog-to-digital (A/D) and digital-to-analog (D/A) converters usually add 3,000-10,000 microseconds of delay. This is why utmost care should be taken to choose minimal latency converters whenever possible. This is particularly relevant for devices that can be used in live performances.
3. Device processing: Each MAGIC device should use no more than 250 microseconds to process and then forward an incoming audio packet.

Latency of data transmitted between directly connected MAGIC devices should not exceed 250 microseconds. This does not include A/D and D/A conversion. As a MAGIC system and link is designed to be a live performance digital link, care must be taken when choosing A/D and D/A converters to minimize latency within these devices.

Jitter

The jitter performance required for a specific application must be taken into account when designing the sample rate recovery circuits. For high quality A/D and D/A conversion, jitter should not exceed 80 ps. Extreme care must be taken when propagating the sample clock within a large system. The MAGIC system is designed with the expectation that the device itself will manage the jitter to an acceptable level. In this manner, the designer can determine the required quality of the resultant jitter at the appropriate cost and return.

Power

MaGIC Phantom Power Source

MAGIC phantom power sources shall supply 18-24 v DC, at greater than 500 mA to each connected instrument, measured at the cable termination on the instrument. The source should supply 18 to 24 Volts on pins 7 and 8 measured at the B-port. This should ensure the minimum voltage of 9 v DC across the maximum cable length.

The phantom power source must be capable of delivering at least 500 mA to each Port B MAGIC data link. Current limiting should occur at a point greater than 500 mA (1 amp recommended). It should not be in the form of a standard fuse, as such a device would need to be replaced if an over-current condition occurred. It is desirable that the full power be restored upon correction of the fault. Each Port B MAGIC data link must be independently protected so that one defective link cannot stop all other links from functioning. All Port B MAGIC Links must supply the above-specified phantom power.

MAGIC Phantom Powered Instrument

Phantom powered devices must properly operate on a range of voltages from 24 v DC down to 9 v DC. The phantom powered device must not draw more than 500 mA while in operation. Proper heat dissipation and or cooling of the instrument at 24 vDC must be considered during the physical design of the instrument.

Phantom Power Considerations when using Daisy Chained Devices

Use of Phantom Power

Special consideration must be given to phantom power in a daisy chain configuration of MAGIC. If more than one device within the chain were allowed to use the power supplied by the MAGIC data link, the power budget would likely be exceeded. Therefore it is recommended that only end point devices, such as instruments, be permitted to use the power supplied by the G100TX cable.

Phantom Power Source and Pass Through

Phantom power distribution must be carefully managed. At first, it would seem that allowing phantom power to physically pass through a device within the chain would be ideal. However, this design can create unsupportable configurations. Since the ultimate chain length is indeterminate, the user could unknowingly violate the maximum cable length specification. Exceeding the maximum cable length would cause excessive voltage drop in the cable thereby limiting the voltage at the instrument to less than the required minimum voltage.

A device may only pass along the phantom power if the available voltage at its Port A MAGIC connector is greater than 20 vDC with a load of >500 mA. This simple test will insure that proper power will be supplied to the instrument even when attached by a 500-foot cable. If this condition cannot be met, the device must supply its own phantom power.

Master Timing Control & Device Enumeration

System Timing Master

When dealing with sampled data it is imperative to achieve sample synchronization. This synchronization insures that all devices are processing data in phase with one another. There is always one source of synchronization in a MAGIC system, and that device is called the System Timing Master (STM). Thus, the System Timing Master (STM) is the single device on a MAGIC network that ensures that all devices are processing data in phase with one another by providing the sample clock and that enumerates all devices on the network by assigning them unique addresses to which they can respond. The MAGIC system makes the selection of the STM automatic and transparent to the user.

Establishing the STM

When multiple devices are daisy chained together or wired in a more hub-centric format, the following three rules are used to establish the STM (these rules are dependent on the device definitions as follows:

1) A device with only an A Port can never be the STM.

2) A device with only B Ports will be the STM.

3) If all devices in the system contain both A and B ports, then the one device not connected on its A-port will be the STM.

Examples of STM

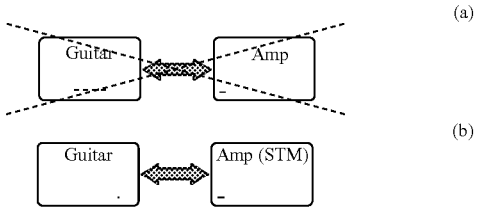

The example above shows a simple network consisting of a Guitar (one A-port, no B ports) and an end-point Amplifier (no A-port, one B port). Rule 1 above disqualifies the Guitar from being the STM, while Rule 2 uniquely identifies the end-point Amplifier as the network STM.

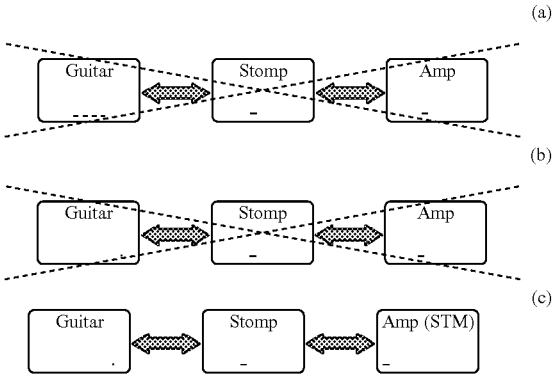

Consider above another fairly simple network consisting of a Guitar (one A-port, no B ports), a Stomp Box (one A-port, one B port), and an Amplifier (one A-port, one B port). As in the previous example, Rule 1 disqualifies the Guitar and Rule 2 is obviously not applicable. Rule 3 however, disqualifies the Stomp Box (because it is connected on its A-port) in favor of the Amplifier that becomes the unambiguous STM.

The following example consists of a Routing Hub (no A-port, and three B ports) connected to three devices. Again, Rule 1 disqualifies the Instruments and Rule 2 uniquely identifies the Routing Hub as the STM.

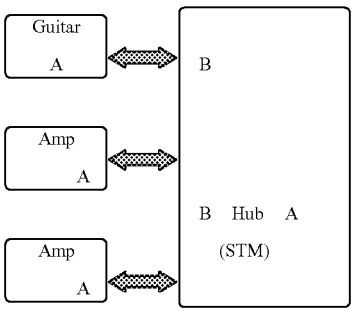

This final example depicts a relatively complex MAGIC network. The application of Rules 1 and 3 in the same way shown above reveals the Mixer as the unambiguous network STM.

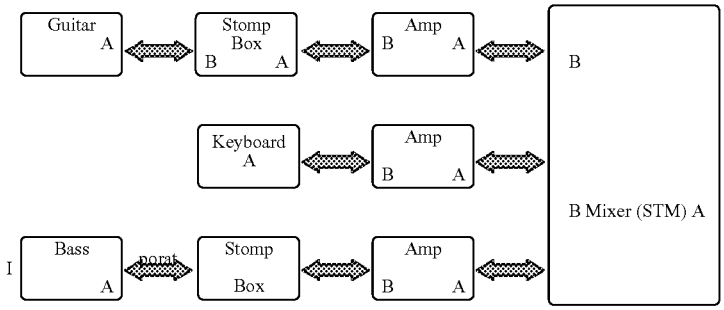

The STM serves two purposes: it provides the sample clock, and enumerates all devices on the MAGIC data link. The process of enumeration assigns each device with a unique 16-bit address. This theoretically limits the number of addresses in a MAGIC system to 65,356 (ranging from 0x0 to 0xFFFF). Three addresses are reserved for broadcast messages, leaving the remaining 65506 addresses available for devices.

Enumeration is not a real-time operation. It requires devices to process data independent of the audio sampling. With the exception of devices that have no B port, all devices must be capable of assuming the role of the STM.

System Startup

When a device powers up, it must determine whether or not it is the network STM. If so, it must assign itself the STM startup address and then proceed to enumerate the rest of the network. If not, the device must assign itself the Non-STM startup address and wait for the STM to assign it a unique one.

The STM and non-STM startup addresses are defined as follows:

| Description | Address |
|---|---|
| Non-STM startup Address | 0xFFFC |
| STM startup Address | 0x0000 |

Once a device establishes itself as the STM it will automatically assign itself the base address. No valid audio must be transmitted until the enumeration process is complete After addressing itself, the STM should begin the enumeration process. Address fields other then the device address fields should use the "not in use" address 0x0000 during enumeration.

Enumeration Algorithm

Since any device other then an instrument can be the STM, it is necessary for all non-instrument devices to be able to perform the enumeration process. Sending an enumeration control message requires specifying a source device address, a destination device address, a control message type, and optional control data.

The following table lists the enumeration messages and their corresponding values to be set in the Control Message and the Control Data fields of the MAGIC packet.

| Message | Control Message | Control Data |
|---|---|---|
| Enumerate Device | 0x0001 | Next device address |
| Address Offset Return | 0x0002 | Device address + 1 |

-continued

| Message | Control Message | Control Data |
|---|---|---|
| Request New Device Address | 0x0003 | None |
| Reset Enumeration | 0x0004 | None |
| Reserved for future use | 0x0005-0x0008 | Currently undefined |

Enumeration Algorithm Messages

Initial Network Enumeration

After powering up, the STM initializes itself as address 0x0000 and issues an Enumerate Device message on all its connected ports with Control Data set to the next address: 1. The next device receives that packet, assigns itself the address 1, and retransmits the packet to the next device in the daisy chain with Control Data set to the next address: 2. The process continues until all devices are enumerated.

When an end-point is reached, that device must issue an Address Offset Return message back to the STM with Control Data set to the next address in order to notify it of the number of devices on the network. Upon processing the Address Offset Return message, the STM can be sure that the network is enumerated and it also knows how many devices there are on the network Note that devices with multiple B ports cannot obviously enumerate the daisy-chains connected to their B-ports simultaneously. They enumerate these chains sequentially and only forward the very last Address Offset Return they receive back to the STM.

The pseudo-code specified below represents the algorithm to be followed by the devices in any arbitrary MAGIC network in order to enumerate with respect to the STM.

```
General constants:
ENUMERATE_DEVICE                = 0x0001;
ADDRESS_OFFSET_RETURN           = 0x0002;
REQUEST_NEW_DEVICE_ADDRESS      = 0x0003;
RESET_ENUMERATION               = 0x0004;
STM_ADDRESS             = 0x0000;
STARTUP_ADDRESS         = 0xFFFC;
BROADCAST_ADDRESS       = 0xFFFF;
STM Device Enumeration:
Device.address          = STM_ADDRESS;
Device.nextDeviceAddress = Device.address + 1;
SEND_MESSAGES: For each B Port {
  SendMessage(Destination address = STARTUP_ADDRESS,
      Source address = Device.address,
      Control message = ENUMERATE_DEVICE,
      Control data 1 = Device.nextDeviceAddress);
  Message aor = Get Address Offset Return message;
  Device.nextDeviceAddress = aor.controlData1;
```

-continued

```
}
Non-STM Device Enumeration:
Device.address = STARTUP_ADDRESS;
Message ed = Get the Enumerate Device message;
Device.address = ed.controlData1;
Device.nextDeviceAddress = ed.controlData1 + 1;
Goto SEND_MESSAGES
SendMessage(Destination address = ed.sourceAddress,
      Source address = Device.address,
      Control message = ADDRESS_OFFSET_RETURN,
      Control data 1 = Device.nextDeviceAddress);
```

A MAGIC system allows for devices to be dynamically connected or disconnected without disrupting the remaining network. This requires MAGIC networks to have the ability to select a new STM if necessary and re-enumerate with respect to it.

If the device being connected on the A-port is the STM of its network, it must by Rule 3 relinquish that status by broadcasting a Reset Enumeration message to all the devices connected to its B-ports. Each device receiving this message must set its address to the startup value of 0xFFFC and forward the message on.

If the device being connected on the B-port is an STM, it will now be the STM of the new combined network. It must follow the protocol described above to enumerate the new network. If it is not the STM, it must issue a Request New Device Address to the STM to notify it of the newly connected devices. Upon receiving that request, the STM must issue an Enumerate Device message with the Control Data set to whatever next device address is available.

The pseudo-code for this algorithm is shown below.

General Constants: See Pseudo-Code Above

```
New connection on the A-port or Processing a Reset
Enumeration Message:
if (Device.address = STM_ADDRESS) {
  Device.address = STARTUP_ADDRESS;
  For each B Port {
    SendMessage(Destination address = BROADCAST_ADDRESS,
      Source address     = Device.address,
      Control message    = RESET_ENUMERATION);
  }
}
New connection on the B port:
if (Device.address = STM_ADDRESS) {
  Follow the STM Device Enumeration algorithm described above
}
else if (Device.address != STM_ADDRESS
      && Device.address != STARTUP_ADDRESS) {
  SendMessage(Destination address = STM_ADDRESS,
      Source address     = Device.address,
      Control message    = REQUEST_NEW_DEVICE_ADDRESS);
  }
}
```

-continued

```
Processing a Request New Device Address Message:
Message rnda = Get the Request New Device Address Message;
SendMessage(Destination address = STARTUP_ADDRESS,
      Source address = Device.address,
      Control message = REQUEST_NEW_DEVICE_ADDRESS,
      Control data 1 = Device.nextDeviceAddress);
Message aor = Get Address Offset Return message;
Device.nextDeviceAddress = aor.controlData1;
```

As described in the pseudo-code above, the next device in the chain will receive the "Enumerate device" message from the STM, address itself as the number provided in the incoming message, increment the data field, and then send the new "Enumerate device" message upstream. It is important to recognize that the device should not pass the original STM message along. The new "Enumerate device" message should maintain the source and destination addresses of the original message.

The process above should be followed for each device in the system except for the last device. The Nth device in the system, which represents the other end point in the daisy chain should address itself with the number provided in the incoming message and then send an "Address offset return" message back to the address provided in the source address field (usually the STM). The "Address offset return" message should use the "base address"(STM) as a destination address, and the device's own address as the source address. The data field should equal the device address plus one.

Disconnecting an A-port and a B-port splits one network into two smaller ones. The device with the A-port becomes an STM by Rule 3. It must issue an Enumerate Device message to re-enumerate its network.

The pseudo-code for this algorithm is shown below.

General Constants: Above

```
Disconnection on the A-port:
if Device is capable of being an STM {
  Device.address = STARTUP_ADDRESS;
  For each B Port {
    SendMessage(Destination address = BROADCAST_ADDRESS,
      Source address     = Device.address,
      Control message    = RESET_ENUMERATION);
  }
  Follow the STM Device Enumeration algorithm above;
```

Data Link Layer

Overview

The data packets sent between MAGIC devices are at the heart of the MAGIC system. They contain the audio information sent between devices as well as control information. The MAGIC system and method are based on the following 32-bit, 55-word frame or packet used by the Data Link Layer for exchanging audio and control information between devices.

| Word | B31-B28 | B27-B24 | B23-B20 | B19-B16 | B15-B12 | B11-B8 | B7-B4 | B3-B0 |
|---|---|---|---|---|---|---|---|---|
| 0 | 5 | 5 | 5 | 5 | 5 | 5 | 5 | 5 |
| 1 | D | 5 | 5 | 5 | 5 | 5 | 5 | 5 |
| 2 | Destination MAC Address | | | | | | | |
| 3 | Source MAC Address | | | | Destination MAC Address continued | | | |
| 4 | Source MAC Address Continued | | | | | | | |
| 5 | | | | | | Length | | |
| 6 | | | | | | | | |

-continued

| Word | B31-B28 | B27-B24 | B23-B20 | B19-B16 | B15-B12 | B11-B8 | B7-B4 | B3-B0 |
|---|---|---|---|---|---|---|---|---|
| 7 | | | | | | | | |
| 8 | | | | | | | | |
| 9 | | | | Reserved for Networking | | | | |
| 10 | | | | Headers | | | | |
| 11 | | | | | | | | |
| 12 | Validity | Cable Num | S-Rate | RFGM | | | | |
| 13 | | | | Frame Count | | | | |
| 14 | | | | Audio Valid | | | | |
| 15 | | | | Audio Express | | | | |
| 16 | | | | Audio Slot 1/Data | | | | |
| 17 | | | | Audio Slot 2/Data | | | | |
| 18 | | | | Audio Slot 3/Data | | | | |
| 19 | | | | Audio Slot 4/Data | | | | |
| 20 | | | | Audio Slot 5/Data | | | | |
| 21 | | | | Audio Slot 6/Data | | | | |
| 22 | | | | Audio Slot 7/Data | | | | |
| 23 | | | | Audio Slot 8/Data | | | | |
| 24 | | | | Audio Slot 9/Data | | | | |
| 25 | | | | Audio Slot 10/Data | | | | |
| 26 . . . 47 | | | | Audio Slots 11 . . . 32/Data | | | | |
| 48 | | | Control Message | | | Version | | Control Protocol |
| 49 | | | Destination Device Address | | | | Source Device Address | |
| 50 | | | Destination Component Address | | | | Source Component Address | |
| 51 | | | | Control Data 1 | | | | |
| 52 | | | | Control Data 2 | | | | |
| 53 | | | | Control Data 3 | | | | |
| 54 | | | | CRC35 | | | | |

The fixed size packet shown above is transmitted between MAGIC devices at precisely 48 kHz. The Data Link Layer includes words 1-11 and bits 1-15 of word 12. Bits 16-31 of word 12 and words 13-53 comprise the Payload and are described below.

The following table describes the Preamble and Start of Frame words:

| Word | B31-B28 | B27-B24 | B23-B20 | B19-B16 | B15-B12 | B11-B8 | B7-B4 | B3-B0 |
|---|---|---|---|---|---|---|---|---|
| 0 | 5 | 5 | 5 | 5 | 5 | 5 | 5 | 5 |
| 1 | D | 5 | 5 | 5 | 5 | 5 | 5 | 5 |

Words 0 and 1 are as described in sections 7.2.3.2 and 7.2.3.3 of CSMA/CD IEEE 802.3 specification.

The table below describes the source and destination MAC addresses:

| Word | B31-B28 | B27-B24 | B23-B20 | B19-B16 | B15-B12 | B11-B8 | B7-B4 | B3-B0 |
|---|---|---|---|---|---|---|---|---|
| 2 | | | | Destination MAC Address | | | | |
| 3 | | Source MAC Address | | | | Destination MAC Address continued | | |
| 4 | | | | Source MAC Address Continued | | | | |

Words 2-4 specify the source and destination worldwide unique MAC addresses. This will allow MAGIC devices to remain compatible with existing and future network hardware.

As shown in the table below, the length field that extends between bits 0-15 of word 5 ensures compatibility with Ethernet and WAN routing equipment. As defined by the Ethernet standard, this field must contain the number of bytes following this field, except the CRC. As can be seen, that adds up to 194 bytes (0x00C2). This remains the ever-constant value of this field.

| Word | B15-B12 | B11-B8 | B7-B4 | B3-B0 |
|---|---|---|---|---|
| 5 | | Length | | |

The table below shows words reserved for network headers. Bits 16-31 of word 5, words 6-11, and bits 0-15 of word 12 are reserved for inserting data compatible with the TCP/IP categories, UDP encapsulation, or WAN applications. They are not used in isolated MAGIC networks.

| Word | B31-B28 | B27-B24 | B23-B20 | B19-B16 | B15-B12 | B11-B8 | B7-B4 | B3-B0 |
|---|---|---|---|---|---|---|---|---|
| 5 | | | | | | | | |
| 6 | | | | | | | | |
| 7 | | | | | | | | |
| 8 | | | | | | | | |
| 9 | | | | | | | | |

-continued

| Word | B31-B28 | B27-B24 | B23-B20 | B19-B16 | B15-B12 | B11-B8 | B7-B4 | B3-B0 |
|---|---|---|---|---|---|---|---|---|
| 10 | Reserved for Networking Headers | | | | | | | |
| 11 | | | | | | | | |
| 12 | | | | | | | | |

Application Layer

Overview

The MAGIC Application Layer is based on a 32-bit, 41.5 word packet used to transport real-time audio and control data, as shown below. Note that the word indices in the left most column have been preserved with respect to the payload field of the MAGIC frame shown above.

| Word | B31-B28 | B27-B24 | B23-B20 | B19-B16 | B15-B12 | B11-B8 | B7-B4 | B3-B0 |
|---|---|---|---|---|---|---|---|---|
| 12 | Configuration | Bits | Cable Name | S-Rate | | | | |
| 13 | Frame Count,Timecode | | | | | | | |
| 14 | Audio Valid | | | | | | | |
| 15 | Audio Express | | | | | | | |
| 16 | Audio Slot 1/Data | | | | | | | |
| 17 | Audio Slot 2/Data | | | | | | | |
| 18 | Audio Slot 3/Dots | | | | | | | |
| 19 | Audio Slot 4/Data | | | | | | | |
| 20 | Audio Slot 5/Data | | | | | | | |
| 21 | Audio Slot 6/Data | | | | | | | |
| 22 | Audio Slot 7/Data | | | | | | | |
| 23 | Audio Slot 8/Data | | | | | | | |
| 24 | Audio Slot 9/Data | | | | | | | |
| 25 | Audio Slot 10/Data | | | | | | | |
| 26 . . . 47 | Audio Slots 11 . . . 32/Data | | | | | | | |
| 48 | Control Message | | | | Version | | Configuration | |
| 49 | Destination Device Address | | | | Source Device Address | | | |
| 50 | Destination Component Address | | | | Source Component Address | | | |
| 51 | Control Data 1 | | | | | | | |
| 52 | Control Data 2 | | | | | | | |
| 53 | Control Data 3 | | | | | | | |

The MAGIC packet can be divided into the following logical sections:

Configuration: Fields that specify the context and configuration in which to interpret the packet.

Audio: Fields containing the audio samples and related control bits.

Data: The same fields that usually contain audio can be configured to contain arbitrary data if needed.

Control: Fields containing control messages and data being exchanged between MAGIC devices.

Audio

Audio Valid

| Word | B31-B28 | B27-B24 | B23-B20 | B19-B16 | B15-B12 | B11-B8 | B7-B4 | B3-B0 |
|---|---|---|---|---|---|---|---|---|
| 14 | Audio Valid | | | | | | | |

Word 14 of the MAGIC packet is used to determine which audio slots (see below) contain valid audio. Bits 0-31 of this word are mapped to Audio Slots 1-32 (words 16-47) respectively. For example, if bit 0 were set it would imply valid audio in Audio Slot 1. If bit 1 were set it would imply valid audio in Audio Slot 2, and so on. If the audio valid word is set to zero, words 16-47 can be used to store and transmit arbitrary data.

Audio Express

| Word | B31-B28 | B27-B24 | B23-B20 | B19-B16 | B15-B12 | B11-B8 | B7-B4 | B3-B0 |
|---|---|---|---|---|---|---|---|---|
| 15 | | | | Audio Express | | | | |

Much like the Audio Valid word described above, bits 0-31 of word 15 are mapped to Audio Slots 1-16 (words 16-47) respectively. This allows a sample arriving on the corresponding input channel to be expressed unaltered on the mapped output channel. For example, setting bit 0 would forward Audio Slot 1 unchanged to the mapped output channel. If bit 1 were set it the same would happen to Audio Slot 2, and so on. This feature allows simpler devices within a Daisy Chain to reduce overhead, particularly when multiplexing with a higher bandwidth backbone. By definition, this feature is not applicable to end points in a network. A hub may or may not respond to these bits depending upon its specific function. For example, it must respond when providing an uplink but may choose to ignore them in the case of a mixer. Sending an audio slot with its audio express bit high does not guarantee that the slots will be passed through to the other port. Where the audio is expressed depends entirely on the input channel to output channel mapping. Setting this bit only ensures that the audio will bypass any processing or alteration.

Audio Slots

| Word | B31-B28 | B27-B24 | B23-B20 | B19-B16 | B15-B12 | B11-B8 | B7-B4 | B3-B0 |
|---|---|---|---|---|---|---|---|---|
| 16 | | | | Audio Slot 1 (first sample) | | | | |
| 17 | | | | Audio Slot 2 (second sample) | | | | |
| 18 | | | | Audio Slot 3 (third sample) | | | | |
| 19 | | | | Audio Slot 4 (fourth sample) | | | | |
| 20 | | | | Audio Slot 5 (fifth sample) | | | | |
| 21 | | | | Audio Slot 6 (sixth sample) | | | | |
| 22 | | | | Audio Slot 7 (seventh sample) | | | | |
| 23 | | | | Audio Slot 8 (eighth sample) | | | | |
| 24 | | | | Audio Slot 9 (ninth sample) | | | | |
| 25 | | | | Audio Slot 10 (tenth sample) | | | | |
| 26 . . . 47 | | | | Audio Slots 11 . . . 32 (eleventh . . . thirty-second samples) | | | | |

Words 16-47 of the MAGIC packet contain the audio samples. This notion of slots allows a MAGIC system to support multiple sample rates by providing a flexible mapping between the rate and the channels being transmitted. As shown in the table above, at the default sample rate of 48 kHz, each audio slot corresponds to a single sample mapped to a single channel. Therefore at this rate, one sample each, thirty-two different channels may be transmitted.

In order to achieve higher fidelity, it is desirable to operate the network at a higher sample rate. At a sample rate of 96 kHz, one channel of audio is assigned two audio slots resulting in a possible transmission of two samples each, belonging to sixteen different channels as shown below:

| Word | B31-B28 | B27-B24 | B23-B20 | B19-B16 | B15-B12 | B11-B8 | B7-B4 | B3-B0 |
|---|---|---|---|---|---|---|---|---|
| 16 | | | | Audio Slot 1 (first sample) | | | | |
| 17 | | | | Audio Slot 2 (second sample) | | | | |
| 18 | | | | Audio Slot 3 (first sample) | | | | |

-continued

| Word | B31-B28 | B27-B24 | B23-B20 | B19-B16 | B15-B12 | B11-B8 | B7-B4 | B3-B0 |
|---|---|---|---|---|---|---|---|---|
| 19 | | | | Audio Slot 4 (second sample) | | | | |
| 20 | | | | Audio Slot 5 (first sample) | | | | |
| 21 | | | | Audio Slot 6 (second sample) | | | | |
| 22 | | | | Audio Slot 7 (first sample) | | | | |
| 23 | | | | Audio Slot 8 (second sample) | | | | |
| 24 | | | | Audio Slot 9 (first sample) | | | | |
| 25 | | | | Audio Slot 10 (second sample) | | | | |
| 26 . . . 47 | | | | Audio Slots 11 . . . 32 (. . . so on) | | | | |

The following table shows the mapping between sample rate, audio slots, and channels transmitted at the various defined MAGIC network sample rates.

| Sample Rate (kHz) | Slots per Channel | Total Channels |
|---|---|---|
| 44.1 | 1 | 32 |
| 48 | 1 | 32 |
| 96 | 2 | 16 |
| 192 | 4 | 8 |

Data

If the Audio Valid word is set to zero, words 16-47 become available for transmitting arbitrary data, as shown below. The format must be mutually agreed upon between the sender and recipient. Note that these fields must not be used for control data.

| Word | B31-B28 | B27-B24 | B23-B20 | B19-B16 | B15-B12 | B11-B8 | B7-B4 | B3-B0 |
|---|---|---|---|---|---|---|---|---|
| 16 | | | | | Data | | | |
| 17 | | | | | Data | | | |
| 18 | | | | | Data | | | |
| 19 | | | | | Data | | | |
| 20 | | | | | Data | | | |
| 21 | | | | | Data | | | |
| 22 | | | | | Data | | | |
| 23 | | | | | Data | | | |
| 24 | | | | | Data | | | |
| 25 | | | | | Data | | | |
| 26 . . . 47 | | | | | Data | | | |

Control

In one embodiment of the system of this invention, there are two defined control protocol types: MAGIC and MIDI. To denote that the native MAGIC protocol is being used, bit 7 of this byte must be set high. Bits 0-2 are used to store the frame rate for Timecode. The following table lists the supported rates with the corresponding value to be set in these bits to denote that rate.

| Frame Rate (Hz) | Value |
|---|---|
| 24 | 0x0 |
| 24.97 | 0x1 |
| 25 | 0x2 |
| 29.97 | 0x3 |
| 30 | 0x4 |

Version Number

| Word | B31-B28 | B27-B24 | B23-B20 | B19-B16 | B15-B12 | B11-B8 | B7-B4 | B3-B0 |
|---|---|---|---|---|---|---|---|---|
| 49 | | | | | Version Number | | | |

Bits 8-15 of word 49 of the MAGIC packet are used for specifying the MAGIC protocol version number being used by the network. The 8-bit field should be formatted as follows:

| Bit 7 | Bit 6 | Bit 5 | Bit 4 | Bit 3 | Bit 2 | Bit 1 | Bit 0 |
|---|---|---|---|---|---|---|---|
| Integer | Integer | Integer | Fraction | Fraction | Fraction | Fraction | Fraction |

Version numbers are defined in the standard dot notation. Bits 0-4 are used for the fraction and bits 5-7 for the integer.

Control Message

| Word | B31-B28 | B27-B24 | B23-B20 | B19-B16 | B15-B12 | B11-B8 | B7-B4 | B3-B0 |
|---|---|---|---|---|---|---|---|---|
| 48 | Control Message | | | | | | | |

Bits 16-31 of word 48 define the control message being sent. For specific examples of control messages, see the descriptions below on Enumeration, Sample Rate Modification, and Virtual Control Links.

Source and Destination Device Addresses

| Word | B31-B28 | B27-B24 | B23-B20 | B19-B16 | B15-B12 | B11-B8 | B7-B4 | B3-B0 |
|---|---|---|---|---|---|---|---|---|
| 49 | Destination Device Address | | | | Source Device Address | | | |

Word 49 contains the destination device and the source device addresses in bits 16-31 and 0-15 respectively.

These fields allow a device to address a control packet from itself to another device on the network. As a control packet is sent from one device to another, each device evaluates the Destination Device Address field to determine if it should process the packet. If not, it must forward the packet along the network ensuring that the packet will eventually reach its intended destination(s).

Control packets can also be broadcast to a group of devices. The following table lists reserved addresses (not assigned to any device during enumeration) that can be used for broadcasting:

| Name | Address | Description |
|---|---|---|
| System Broadcast | 0xFFFF | All devices on a network must process a message with this destination address. |
| Local Hub Broadcast | 0xFFFE | If a hub generates this broadcast it must forward it to all its B ports. If it receives the message on one of its ports, it should process it and then forward it on all ports except it's A port, and the port it received the message on. |
| Daisy Chain Broadcast | 0xFFFD | All devices on a Daisy Chain must process and forward this broadcast. A hub should only forward it to its B ports if it generates the message itself or if it receives it on it's A port |
| Startup | 0xFFFC | Self-assigned startup address for all devices. See chapter 5 for details. |
| Base | 0x0000 | Addressed used by the STM. See chapter 5 for details. |

Source and Destination Component Addresses

| Word | B31-B28 | B27-B24 | B23-B20 | B19-B16 | B15-B12 | B11-B8 | B7-B4 | B3-B0 |
|---|---|---|---|---|---|---|---|---|
| 50 | Destination Component Address | | | | Source Component Address | | | |

Word 50 contains the destination component and the source component addresses in bits 16-31 and 0-15 respectively. Components and their function are defined in detail below.

These fields (in conjunction with the Source and Destination Device Address) allow a component on a device to address a control packet from itself to another component on a device on the network. Once the destination device receives the control packet, it can use the Destination Component Address field to direct the control information to the appropriate component.

Control Data

| Word | B31-B28 | B27-B24 | B23-B20 | B19-B16 | B15-B12 | B11-B8 | B7-B4 | B3-B0 |
|---|---|---|---|---|---|---|---|---|
| 51 | | | | Control Data 1 | | | | |
| 52 | | | | Control Data 2 | | | | |
| 53 | | | | Control Data 3 | | | | |

Words 51 through 53 are designated for control data. These fields are used to transmit supporting data for control messages. Examples of how these fields are used can be found in the discussion of specific packets used in the Enumeration protocol, Sample Rate Modification protocol, and the Virtual Control Link protocol.

Sending and Receiving Control

The flow of audio is fundamentally different from that of control because audio is transmitted synchronously whereas control is not. Audio information is present in every outgoing packet issued at the defined network sample rate. Control information, on the other hand, is included in the packet only when needed. Note that if a certain packet does not contain control, the packet length does not change. Instead, the Control Valid Bit (see below) is set to low to denote that he information contained in the control fields is invalid.

Sending a control packet requires performing the following sequence of actions:

1. The device must first ensure that the adjacent device is ready to receive the control message. This is done using the CTS and MIP control bits described below.
2. The device must setup the appropriate validity bits described below in along with the control fields described earlier in this section.
3. Finally, the control message can be issued as part of the next outgoing packet on the desired port.

Once a device has received a control message, it must check the Destination Device Address field described earlier to determine if the message is intended for itself. If so, it must process the message, otherwise it must forward the message along the Daisy Chain thereby ensuring that the packet will eventually reach its destination.

Configuration

The configuration words in the application layer of the MAGIC packet define the packet validity, cable number, sample rate, floating point format, Message in Progress (MIP) and Clear To Send (CTS) bits, and frame count.

Clear To Send and Message In Progress

| Word | Bit 31 | Bit 30 |
|---|---|---|
| 12 | Clear To Send (CTS) | Message In Progress (MIP) |

Bits 31 and 30 of word 12 are the Message In Progress (MIP) and Clear To Send (CTS) bits respectively. They allow a recipient device to effectively manage its limited control packet buffer space against several possibly faster senders. The following illustrate the use of these bits by considering an example where an arbitrary device X sends a message to an arbitrary adjacent device Y:

1. Initial State:

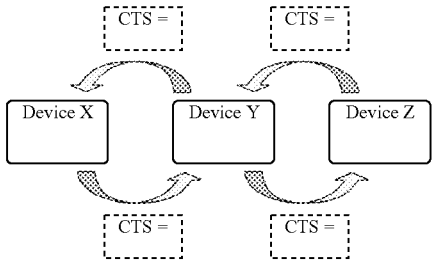

All CTS bits are high indicating that anyone can send a message. All MIP bits are low indicating no messages in progress.

2. Sending a Message:

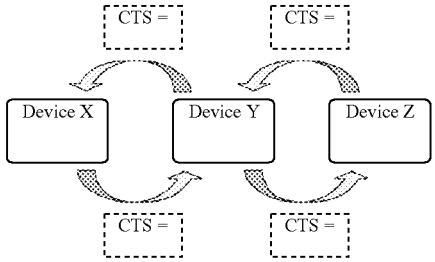

Device X raises the MIP bit on the packets outgoing to device Y once and starts sending control packets. Device Y receives and processes the packets.

3. Controlling the Flow:

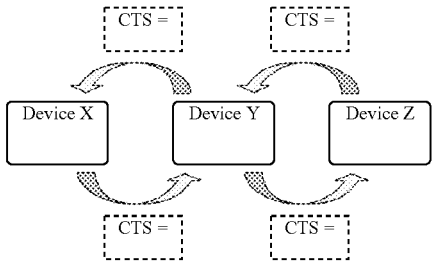

Device Y runs out of buffer space and lowers the outbound CTS to X to notify X of the same. X receives that CTS and stops sending control packets, but keeps its MIP bit high to indicate to Y that it still has packets to send.

Once device Y has emptied its buffers it must raise its outbound CTS bit to X to continue transmission as shown in 2 above. After X has completed its transmission it must lower its outbound MIP bit towards Y and return to the initial state 1 shown above.

In order for this protocol to function correctly, the following rules must be observed:

1. The protocol must be observed every time a control packet passes from a device to its adjacent device.
2. Each device must have the memory required to buffer at least twelve control packets per port at all times. As soon as the available buffer space drops below that, the device must lower its CTS to the sender. Analogously, when the available buffer space rises above twelve control packets, the device can raise its CTS again.

These rules together ensure that a faster sender will not overwhelm a slower recipient by ensuring that each recipient will have adequate time to stop the sender if and when it runs low on available receive buffer space.

Validity

| Word | Bit 29 | Bit 28 | Bit 27 | Bit 26 |
|---|---|---|---|---|
| 12 | Control Valid (CV) | Control Data Valid (CDV) | Joined with Next Valid Frame (JNVF) | CRC Valid |

This most significant nibble of word 12 determines whether certain parts of the packet are valid or not:

Bit 29 denotes whether the Control Message in word 48 is valid or not.

Bit 28 denotes whether the Control Data in words 51-53 is valid or not.

Bit 27 denotes whether there are more packets following this one as part of a multi-packet transmission. It is used when more data than can fit into a single packet is to be transmitted. By setting this bit on all packets comprising the transmission except the last one, the sender can notify the recipient(s) of the same.

Bit 26 denotes whether the CRC defined in word 54 is valid or not.

These validity bits have been placed towards the beginning to notify hardware designers of the packet contents as early as possible. This allows them to design efficient systems that can allocate necessary resources to process the packet.

Bit 25 of word 12 is unused.

Floating Point Format

| Word | Bit 24 |
|---|---|
| 12 | Floating Point Format |

Bit 24 of word 12 defines the Floating Point Format (FPF). When high, this bit indicates to the recipient that the audio in words 16-47 of the packet is in floating-point format as described in the IEEE 754/854 floating-point standard. When low, those words are in standard 32-bit fixed-point format. The default is fixed-point because most commonly used CODECs do not support floating-point data. This does force an expensive conversion to floating-point when using a 32-bit floating-point DSP. Allowing the advanced user the option to toggle between these two types can make significantly improve performance in certain applications.

Cable Number

| Word | B23-B20 |
|---|---|
| 12 | Cable Number |

The cable number allows for the labeling of MAGIC streams that may be multiplexed onto a high bandwidth medium such as a Gigabit Ethernet.

Sample Rate

| Word | B19-B16 |
|---|---|
| 12 | Sample Rate |

This nibble specifies the sample rate at which the packet is being transmitted across the network. The following table shows the currently supported sample with corresponding values (to be set in the sample rate nibble of the packet):

| Sample Rate (kHz) | Value |
|---|---|
| 44.1 | 0x1 |
| 48 (default) | 0x2 |
| 96 | 0x3 |
| 192 | 0x4 |
| Reserved for future use | 0x5-0xF |

The default sample rate is 48 kHz. All MAGIC devices are required to startup at that rate. Increasing the sample rate to 96 kHz allows capable devices to send two samples per packet by reducing the number of audio channels to eight. Similarly, increasing the sample rate to 192 kHz allows capable devices to send four samples per packet by reducing the number of audio channels to four.

Individual devices may be capable of different sample rates. It is therefore necessary for the entire network to agree upon a universally supported sample rate. The protocol described below provides the procedure for modifying the network sample rate.

Frame Count/Timecode

| Word | B31-B28 | B27-B24 | B23-B20 | B19-B16 | B15-B12 | B11-B8 | B7-B4 | B3-B0 |
|---|---|---|---|---|---|---|---|---|
| 13 | Frame Count/Timecode | | | | | | | |

The configuration bits described below determine the content of word 13. This word can either be used as a counter for the number of frames transmitted, or to store Timecode. When used as a counter, the number stored in this field will roll over when it reaches the maximum 32-bit number 0xFFFFFFFF. Due to the fact that the frames always travel at 48 kHz, the frame count field has a rollover rate of 24.86 hours.

Frame Count/Timecode Configuration

| Word | Bits 5-0 |
|---|---|
| 48 | Frame Count/Timecode Configuration |

Bits 0 and 1 of word 48 determine the content of word 13. The following table lists the configuration options:

| Configuration | Value |
|---|---|
| Frame Count | 00 |
| MAGIC Timecode | 01 |
| MIDI Timecode | 10 |

Bits 2-5 are used to store the frame rate for the Timecode. The following table lists the supported rates with the corresponding value to be set in these bits to denote that rate.

| Frame Rate (Hz) | Value |
|---|---|
| 24 | 0x0 |
| 24.97 | 0x1 |
| 25 | 0x2 |
| 29.97 | 0x3 |
| 30 | 0x4 |

Bits 6 and 7 are unused.

Modifying the Network Sample Rate

Once a network has been enumerated and packets are being exchanged at the mandatory startup sample rate of 48 kHz, a device capable of a higher sample rate can request that the network upgrade to a higher rate. The following table lists the messages with their corresponding Control Message and Control Data field values:

| Message | Control Message | Control Data |
|---|---|---|
| Request New Sample Rate | 0x5 | 0x0000 |
| Acknowledge New Sample Rate | 0x6 | 0x0001 |
| Reject New Sample Rate | 0x7 | 0x0002 |
| Modify Sample Rate | 0x8 | 0x0003 |

In order to request a sample rate change, a device must broadcast a Request New Sample Rate message to the STM. The STM then forwards that through the whole network by sending it out on all its B-ports. Each device processes the request and if it can support the requested rate, forwards it on. Otherwise, it returns a Reject Sample Rate to the STM. Upon receiving the rejection, the STM forwards it onto the device that issued the initial request and the process ends. When the request reaches an end-point, that device must issue an Acknowledge Sample Rate to the STM. Once the STM has received acknowledgements from the daisy chains connected to each of its B-ports, it issues a Modify Sample Rate message through the network. Each device processes this packet, updates its sample rate, and then forwards it onto the next device. When the packet reaches an end-point, that device must return the packet back to the STM. The STM upon receiving the modification packets back from the daisy chains connected to each of its B-ports knows that the network rate was successfully modified and ends the process.

If the STM receives another request for a sample rate modification while one is in progress it is permitted to discard that request. The responsibility for re-trying rests on the shoulders of the device issuing the request. All audio must be muted while the sample rate change takes place. How that is done is application dependent and has therefore left to the discretion of the implementer.

Set forth below is the pseudo-code for this algorithm:

| General Constants and Global Variables: see above | |
|---|---|
| MSR_REQUEST | 0x0005 |
| MSR_ACKNOWLEDGE | 0x0006 |
| MSR_REJECT | 0x0007 |
| MSR_MODIFY | 0x0008 |

```
Issuing the request from an arbitrary device to STM:
SendMessage(Destination address = STM_ADDRESS,
        Source address = Device.address,
        Control message = MSR_REQUEST,
        Control data 1 = Device.higherSampleRateCode);
Processing the request by STM:
Message msr = Get the Modify Sample Rate message;
If STM is capable of the sample rate specified by msr.comtrolData1{
    On each B-port{
        SendMessage(Destination address = BROADCAST_
        ADDRESS,
            Source address = Device.address,
            Control message = MRS_REQUEST,
            Control data 1 = msr.controlData1);
    }
}
else Terminate the sample rate modification process.
Processing of the modify sample rate message sent by the STM and
received by each device on the A-port:
Message msr = Get the Modify Sample Rate message From A-port;
If device is capable of the sample rate specified by msr,controlData1{
    if Device has no connected B ports, then on A-port {
        SendMessage(Destination address = msr.sourceAddress,
            Source address = Device.address,
            Control message = MSR_ACKNOWLEDGE,
            Control Data 1 = msr.controlData1);
    }
    else on all B-ports}
        SendMessage(Destination address = BROADCAST_
        ADDRESS,
            Source address = Device.address,
            Control message = MSR_REQUEST,
            Control data 1 = msr.controlData1);
    }
}
else on A-port{
    SendMessage(Destination address = STM_ADDRESS,
        Source address = Device.address,
        Control message = MSR_REJECT,
        Control data 1 = msr.controlData1)
}
Precessing of the acknowledge sample rate message received by each non-
end point device on the B-port:
Message msr = Get the Modify Sample Rate message from B-port;
If acknowledge message has been received from all other B-ports{
    SendMessage(Destination address = BROADCAST_ADDRESS,
            Source address = Device.address,
            Control message = MSR_ACKNOWLEDGE,
            Control data 1 = msr.controlData1);
}
Processing of the acknowledgements and/or rejections by the STM:
Message msr = Get the Modify Sample Rate message;
If msr.controlMessage == MSR_REJECT{
    Terminate the sample rate modification process.
}
```

-continued

```
else if msr.controlMessage == MSR_ACKNOWLEDGE && the same acknowledgement has been received from all other B-ports{
    From this time forward set the audio valid bits for all packets
        to zero;
    SendMessage(Destination address = BROADCAST_ADDRESS,
            Source address = Device.address,
            Control message = MSR_MODIFY,
            Control data 1 = msr.controlData1);
}
Processing of the modify sample rate message sent by the STM and
received by each device on the A-port:
Message msr = Get the Modify Sample Rate message with
controlMessage = MSR_MODIFY;
From this time forward set the audio valid bits for all packets to 0.
Configure the device to operate with the new sample rate specified by
msr.controlData1;
```

-continued

```
if Device has no B ports{
    Send the same message 'msr' back onto the A-port.
    Set the audio valid bits to 0xFFFF and start transmitting audio
    at the new sample rate.
}
else Send the message 'msr' out as-is on all B ports.
```

If a new device is connected to a network enumerated and running at a sample rate that is not supported by that device, the device must indicate the problem to the user and must not transmit any valid audio by setting the Audio Valid word (Word 14) to zero.

Cyclic Redundancy Check

Word 54 [table shows word 55??] of the MAGIC packet contains a 32-bit Cyclic Redundancy Check (CRC) for the data contained in entire packet.

| Word | B31-B28 | B27-B24 | B23-B20 | B19-B16 | B15-B12 | B11-B8 | B7-B4 | B3-B0 |
|---|---|---|---|---|---|---|---|---|
| 55 | | | | CRC35 | | | | |

The algorithm is based on the standard CRC-32 polynomial used in Autodin, Ethernet, and ADCCP protocol standards. The following is an example of a CRC-32 generation function written in C:

```
/*
  * crc32h.c -- package to compute 32-bit CRC one byte at a time using the Big
Endian (highest bit first) bit convention.
  *
  * Synopsis:
  * void gen_crc_table (void):
  *       Generates a 256-word table containing all CRC remainders for every
possible 8-bit byte. It must be executed (once) before any CRC updates.
  *
  *   unsigned update_crc (unsigned long crc_accum, char *data_blk_ptr,
  *                    int data_blk_size):
  *          Returns the updated value of the CRC accumulator after processing each byte
in the addressed block of data.
  *
  * It is assumed that an unsigned long is at least 32 bits wide and a char occupies
one 8-bit byte of storage.
  *
  * The generator polynomial used for this version of the package is
  *
x^32+x^26+x^23+x^22+x^16+x^12+x^11+x^10+x^8+x^7+x^5+x^4+x^2+x^1+x^0
  * as specified in the Autodin/Ethernet/ADCCP protocol standards.
  * Other degree 32 polynomials may be substituted by re-defining the symbol
POLYNOMIAL below. Lower degree polynomials must first be multiplied by an
appropriate power of x. The representation used is that the coefficient of x^0 is
stored in the LSB of the 32-bit word and the coefficient of x^31 is stored in the most
significant bit. The CRC is to be appended to the data most significant byte first.
For those protocols in which bytes are transmitted MSB first and in the same order
as they are encountered in the block
  * this convention results in the CRC remainder being transmitted with the
coefficient of x^31 first and with that of x^0 last (just as would be done by a
hardware shift register mechanization).
  *
  * The table lookup technique was adapted from the algorithm described in Byte-
wise CRC Calculations, Avram Perez, IEEE Micro 3, 4(1983).
```

-continued

```
  */
#define POLYNOMIAL 0x04c11db7L
static unsigned long crc__table[256];
void gen__crc__table( )
  /*
    * Generate the table of CRC remainders for all possible bytes:
    */
{
        register int i, j;
        register unsigned long crc__accum;
                for (i = 0; i < 256; i++) {
          crc__accum = ((unsigned long) i << 24);
          for (j = 0; j < 8; j++) {
            if (crc__accum & 0x80000000L)
        crc__accum = (crc__accum << 1) ^POLYNOMIAL;
      else
        crc__accum = (crc__accum << 1);
          }
          crc__table[i] = crc__accum;
        }
        return;
}
unsigned long update__crc(unsigned long crc__accum, char *data__blk__ptr,
                int data__blk__size)
  /*
    * Update the CRC on the data block one byte at a time
    */
{
        register int i, j;
  for (j = 0; j < data__blk__size; j++) {
    i = ((int) (crc__accum >> 24) ^*data__blk__ptr++) & 0xff;
    crc__accum = ( crc__accum << 8) ^crc__table[i];
  }
  return crc__accum;
}
```

The CRC computation and checking is optional. It can be toggled on or off by using bit 28 of word 12.

Endian Format

All data on a MAGIC network must be Big Endian. Any Little Endian device must accordingly swap the necessary bytes before sending and before processing newly received information.

Control Protocol

Overview

A MAGIC network can be viewed as a collection of Components that are capable of controlling or being controlled by other Components, regardless of which physical devices they might be located on. The Control Protocol provides a generic mechanism for Components of a certain type to control other Components of a similar type on the same network.

A Component is defined as a unit on a MAGIC device that is capable of generating or interpreting a control message. As a simple example, consider a simple knob (rotary encoder) on a device, and a volume on another device on the same network. This protocol would allow the knob to send control messages to regulate the volume in real-time.

There are two types of Components: a Source that can issue a command and a Target that can receive and execute a command. Each device must enumerate its Components and assign them unique unsigned integer addresses between 0 and 65,536. The combination of the 16-bit Device Address assigned during Enumeration and this 16-bit Component Address will uniquely identify any component available on a network.

Each Component must also be assigned a mnemonic name to allow devices with displays to provide named-based access to Components. All names must be limited to 16 characters. A MAGIC system uses the 16-bit Unicode format for transmitting text. Each Component represents a specific parameter. In the example mentioned earlier, the parameter represented by the Source was the knob and the parameter represented by the Target was the volume.

The following table lists the currently defined types of parameters.

| Parameter Type | Value |
|---|---|
| Scale | 0x1 |
| Toggle | 0x2 |
| MIDI | 0x3 |
| Blob | 0x4 |
| Reserved for future standard types | 0x5-0x3E8 |

Parameter Type is defined as a 16-bit value. It is expected that devices will define application-specific types as long as they do not use the values listed in the above table. A Scale parameter is one that ranges from a minimum to a maximum, and can be modified by at unit value. To form such a link, the Source must supply the following values to the Target:

1. Current: present value of the scale
2. Minimum: lowest possible value of the scale
3. Maximum: highest possible value of the scale
4. Unit: minimum amount by which the scale can be incremented/decremented.

These values are required to be 32-bits each although they do not have to be of a specific type. MAGIC-compliant devices must ensure type-independent transmission of control data.

A Toggle parameter is one in which the parameter being controlled is a single binary value. To form such a link, the Source must supply the following values to the Target:

1. Current: present value of the scale

The universal settings of 0 and 1 are used to denote OFF and ON respectively.

A MIDI parameter is a generic type designed for supporting MIDI. By creating Source and Target Components of this parameter type, clients can transmit MIDI messages encapsulated in MAGIC control packets. In order to use this type, a client need not provide any information at Component creation time. Instead, the client must provide the number of bytes in the message, and then the actual message.

A Blob parameter is a generic type designed to allow clients to transmit any amount of information of arbitrary type. Creating Source and Target Components of this type and specifying the number of words to be transmitted is sufficient to deliver the data from the Source to the Target.

Control Links

A Control Link is a mapping between a Source and a Target that allows the former to control the latter by sending it control messages in a defined format. A Link can only be formed between a Source and Target of the same Parameter type (Scale with Scale, Toggle with Toggle, etc.). A Control Link has two pairs of addresses that identify it:

1. Source Device Address and Source Component Address
2. Destination Device Address and Destination Component Address Note that these map directly into words 49 and 50 of the GMIC packet.

Control Messages

The following table lists the Control Messages defined for exchanging information about Components.

| Message | Control Message | Control Data 1 | Control Data 2 | Description |
|---|---|---|---|---|
| Request All Component Information | 0x9 | 0 | None or Parameter Type | Requests information for all Components, or, Components of a specific Parameter type. |
| Request All Source Component Information | 0x9 | 1 | None or Parameter Type | Requests information for all Sources, or, Sources of a specific Parameter type. |
| Request All Target Component Information | 0x9 | 2 | None or Parameter Type | Requests information for all Targets, or, Targets of a specific Parameter type. |
| Return Component Information | 0xA | See below | See below | Supplies information regarding a specific Component |
| Assign Control Link | 0xB | None | None | Sent to a Source and a Target to inform them of a Control Link assignment |
| Send Control | 0xC | See below | See below | Sent by a Source to modify a Target. |

Algorithm

A device can request information about Components by issuing a Request Component Information message. Sending this message involves:

1. Setting the appropriate value in the Control Message field as shown in the table above.
2. Setting one of: 0, 1, or 2 to denote Sources and Targets, only Sources, and only Targets respectively, in the Control Data 1 field.
3. Setting either zero, or a valid Parameter Type (see Table 8-2 above) in the Control Data 2 field.

A device receiving such a message must issue a Return Component Information packet back to the sender for each Component that matches the restrictions specified in the Control Data 1 and Control Data 2 fields. For example, if Control Data 1 and 2 were to both contain zeros; this should result in sending a Return Component Information message for every single Component. If the values were 2 and 1 respectively, the message would be returned for Targets of type Scale only.

Returning information about a specific Component essentially requires transmitting the current values of each of the attributes listed above. Regardless of Component type, the first two words (set in Control Data 1 and 2 respectively,) will have the following format:

| Word Index | Bit Number | Description |
|---|---|---|
| 0 | 22-31 | Currently unused. |
| 0 | 21 | Component Type: Source or Target. |
| 0 | 16-20 | The number of characters in the Component name. The maximum is 16. |
| 0 | 0-15 | Parameter Type |
| 1 | 16-31 | Maximum Control Link count. |
| 1 | 0-15 | Current Control Link count. |

The number of remaining words varies entirely based on the following three categories of data, which must be sent in the order listed below:

1. Control Links: For each control link, a word containing a Device address in bits 0-15 and a Component address in bits 16-31 must be included.
2. Name: For each character a 16-bit Unicode value must be included. Character 0 would occupy bits 0-15 of the first word. Character 1 would occupy bits 16-31, and so on. If the number of characters is odd, then the last 16 bits should be left unused.
3. Parameter type-specific values: A Scale parameter requires four 32-bit values. A Toggle only requires one. Users defining their own parameter types must ensure that the values are easily represented in a collection of 32-bit words.

Therefore, the total number of 32-bit data words that have to be transmitted in order to accurately describe a Component is:

Total word count=2+Control Link Word Count+Name Word Count+Parameter Type Word Count A control packet can only contain three 32-bit data words at once. If Total Word Count exceeds three, the words must be sent in separate control packets issued sequentially. The Joined with Next Valid Frame (JNVF) bit allows packets to be marked logically contiguous.

Any device can assign a Control Link between a Source and a Target on the network. The device making the assignment does not have to be the one with either the Source or the Target. If that is the case, the assigning device must issue the Assign Control Link message to both the Source and the Target. There is no Control Data required for this packet. By setting the appropriate Source and Destination device address fields, the Source and Destination Component address fields, and of course the appropriate Control Message field, the assignment can be made.

Device and Network Name

Devices must define a mnemonic name. They may also optionally provide the user the option to store a mnemonic network name. The following messages allow devices to request and return these names across the network. Both names must be defined in 16-bit Unicode and have a maximum limit of 16 characters.

| Message | Control Message | Description |
|---|---|---|
| Request Device Name | 0xD | Requests the mnemonic network name. |
| Return Device Name | 0xE | Returns the mnemonic network name. |
| Request Network Name | 0xF | Requests the mnemonic network name. |
| Return Network Name | 0x10 | Returns the mnemonic network name. |

Request Device Name does not require any control data and neither does Request Network Name. Both Return Device Name and Return Network Name return names in the same way listed above for Return Component Information. For each character, the 16-bit Unicode value must be included. Character 0 would occupy bits 0-15 of the first word. Character 1 would occupy bits 16-31, and so on. If the number of characters is odd, then the last 16 bits should be left unused.

A control packet can only contain three 32-bit data words at once. If the number of words required exceeds three, they must be sent in separate control packets issued sequentially. The Joined with Next Valid Frame (JNVF) bit allows packets to be marked logically contiguous.

Use of MAGIC System

Typical arrangements of musical instruments and related audio and control hardware in a MAGIC system are shown in FIGS. 1 and 2.

Each of the instruments and the microphones are digital. Each of the amplifiers, preamplifiers and the soundboard are connected using the MAGIC data link described above. The stage has a hub 28 with a single cable (perhaps an optical fiber) running to the control board 22. An optical MAGIC data link will allow over a hundred channels of sound with a 32 bit-192 kHz digital fidelity, and video on top of that.

As each instrument and amplifier are connected into a hub 28 on the stage via simple RJ-45 network connectors, they are immediately identified by the sound board 22 which is really a PC computer with a Universal Control Surface (FIG. 3) giving the sound professional complete control of the room. Microphones are actually placed at critical areas throughout the room to audit sound during the performance. The relative levels of all instruments and microphones are stored on a RW CD ROM disc, as are all effects the band requires. These presets are worked on until they are optimized in studio rehearsals, and fine tuning corrections are recorded during every performance.

The guitar player puts on his headset 27, which contains both a stereo (each ear) monitor and an unobtrusive microphone. In addition, each earpiece has an outward facing mike allowing sophisticated noise canceling and other sound processing. The player simply plugs this personal gear directly into his guitar 12 and the other players do the same with their respective instruments. The monitor mix is automated and fed from different channels per the presets on the CD-ROM at the board. The monitor sound level is of the artists choosing (guitar player is loud).

The guitar player has a small stand-mounted laptop 17 (FIG. 2) that is MAGIC enabled. This allows sophisticated visual cues concerning his instrument, vocal effects and even lyrics. The laptop 17 connects to a pedal board 15 that is a relatively standard controller via a USB cable 16 to a connector on the laptop 17. Another USB cable is run to the amplifier 13, which is really as much of a specialized digital processor as it is a device to make loud music. This guitar 12 is plugged into this amplifier 13, and then the amplifier 13 is plugged into the hub 28 using the MAGIC RJ-45 cables 11.

The laptop 17 contains not only presets, but stores some of the proprietary sound effects programs that will be fed to the DSP in the amplifier, as well as some sound files that can be played back. Should the drummer not show up, the laptop could be used.

The guitar player strums his instrument once. The laptop 17 shows all six strings with instructions on how many turns of the tuner are required to bring the instrument in tune, plus a meter showing the degree of tone the strings have (i.e., do they need to be replaced). The DSP amplifier can adjust the guitar strings on the fly to tune, even though they are out of tune, or it can place the guitar into different tunings. This player, however, prefers the "real" sound so he turns off the auto-tune function.

The best part of these new guitars is the additional nuance achieved by squeezing the neck and the touch surfaces that are not part of the older instruments. They give you the ability to do so much more musically.

The sound technician, for his part is already prepared. The room acoustics are present in the "board/PC". The band's RW CD-ROM contains a program that takes this info and adjusts their entire equipment setup through out the evening. The technician just needs to put a limit on total sound pressure in the house, still and always a problem with bands, and he is done except for monitoring potential problems.

The complexity of sound and room acoustic modeling could not have been addressed using prior art manual audio consoles. Now, there is sophisticated panning and imaging in three dimensions. Phase and echo, constant compromises in the past, are corrected for digitally. The room can sound like a cathedral, opera house, or even a small club.

The new scheme of powered speakers 18 throughout is also valuable. Each speaker has a digital MAGIC input and a 48 VDC power input. These all terminate in a power hub 19 and a hub at the board 22. In larger rooms, there are hubs throughout the room, minimizing cable needs. Each amplifier component is replaceable easily and each speaker is as well. The musician has the added components and can switch them out between sets if necessary.

The MAGIC system dispenses with the need for walls of rack effects and patch bays. All of the functionality of these prior art devices now resides in software plug-ins in either the board-PC or the attached DSP computer. Most musicians will bring these plug-ins with them, preferring total control over the performance environment.

The band can record their act. All the individual tracks will be stored on the board-PC system and downloaded to a DVD-ROM for future editing in the studio.

To set up the MAGIC system, the players put their gear on stage. They plug their instruments into their amplifiers, laptops, etc. These are, in turn, plugged into the MAGIC Hub. The band presets are loaded and cued to song 1. The house system goes through a 30-second burst of adjustment soundtrack, and then the band can be introduced.

The keyboard business several years ago went to a workstation approach where the keyboard product became more than a controller (keys) with sounds. It became a digital control center with ability to control other electronic boxes via midi, a sequencer and included very sophisticated (editing) tools to sculpt the sounds in the box. It included a basic amount of reverb and other sound effects that had been external previously.

In the MAGIC system, the guitar amplifier can be a workstation for the guitar player, encompassing many effects that were previously external. In effect, the amplifier is actually become part of the player's control system, allowing control via the only appendage the player has that is not occupied playing, his foot. Additionally, a small stand mounted laptop will be right by the player where he can make more sophisticated control changes and visually see how his system is functioning. The view screen can even allow the lyrics and chord changes to be displayed in a set list.

The amplifier in the new MAGIC system will allow flexible real time control of other enhancements and integration into the computer and future studio world.

The amplifier can be separated into its constituent parts:

The preamplifier 1 (the controls, or the knobs);

The preamplifier 2 (the sound modifier);

The power stage (simple amplification);

The speakers (create the sound wave envelope).

The cabinet (esthetics and durability);

This is a lot of functionality when you look at the constituent components. The MAGIC system introduces a novel technology and a whole new way of looking at a musical instrument amplifier. Many designers and companies have already identified the constituents of the whole and marketed one of them as a single purpose product with modest success. But, just as a controller keyboard (one without the sounds) has not made a major market penetration, the single purpose constituent is not satisfying to the player. The MAGIC Workstation encompasses all of the constituents in an easy to use form.

As described above, the MAGIC Link uses currently available components, the Ethernet standard (the communications protocol), a commonly used RJ-45 connector and a new communications protocol utilizing Internet type formatting. This allows the system to send ten channels of digital musical sound over standard cables directly from the instrument for further processing and amplification. A new upgraded MIDI standard signal along with a music description language can also travel over this cable. This scheme allows for up to phantom instrument power as described over that same cable to power circuits in the instrument, including D/A conversion.

The MAGIC circuit board is very small and uses custom application specific integrated circuits (ASIC) and surface mount technology. It will connect to standard pick-ups and CPA's in classic guitars and is particularly suited for new hexaphonic pick-ups that provide an individual transducer for every string)

The MAGIC Enabled Musical Instrument

The only noticeable hardware difference in MAGIC enabled traditional instruments will be the addition of a RJ-45 female connector, and a small stereo headphone out. Of course, this innovation makes a host of new possibilities possible in the design of new modern instruments. Older instruments will be able to access most of the new functionality by simply replacing the commonly used monophonic audio connector with a new RJ-45 connector and a tiny retrofit circuit board. Vintage values can be retained.

The original analog output will be available as always with no impact on sound, and the digital features need never be used. The MAGIC system will allow access to both the digital signal and the unadulterated analog signal.

Having eight digital channels available for output, six of these will be used by each string in a six-string instrument. Two channels will be available to be input directly into the instrument for further routing. In a typical set up, one input will be a microphone from the performer's headset and the other input is a monitor mix fed from the main board. The headphones would then be the stereo monitor adjusted to the musicians liking without impacting the sound of the room.

The physical connector will be a simple, inexpensive and highly reliable RJ-45 locking connector, and category 5 stranded 8-conductor cable.

A new hex pickup/transducer will send 6 independent signals to be processed. The transducer is located in the stop bar saddles on the guitar bridge. Alternatively, the classic analog signal can be converted post CPA to a digital signal from the classic original electromagnetic pick-ups. There are also two analog signal inputs that are immediately converted into a digital signal (A/D converter) and introduced into the MAGIC data stream.

This MAGIC ASIC and the MAGIC technology can be applied to virtually every instrument, not just guitars.

The Preamplifier 1 (the Controls, or the Knobs):

The Control Surface

The knobs or controls for the current generation of amplifiers are unusable in a performance setting, and practically in virtually every other setting. It is very difficult to adjust the control knobs in the presence of 110 dB of ambient sound level. Utilizing both the MAGIC and USB protocols, a communication link is available with all components of the performance/studio system. Any component can be anywhere without degrading the sound. The MAGIC standard includes a channel for high-speed control information using the MIDI format but with approximately one-hundred times the bandwidth. Thus, the MAGIC system is backward compatible with the current instruments utilizing MIDI (most keyboards and sound synthesizers).

The display and knobs will be a separate unit. In the MAGIC system, this is referred to as the physical control surface that will be plugged into either the Master Rack directly, or into a laptop computer via a USB connector. When using the laptop, it will function as the visual information screen showing various settings, parameters, etc. Software resident on the laptop will be the music editor allowing control over infinite parameters.

This laptop will be unobtrusive but highly functional and the settings can be displayed on this screen visible from a distance of 12 feet to a player with normal vision. It will have a USB connection. There will also be a pedal controller with a USB or MAGIC out to the Master Rack where processing shall take place. Because both MAGIC and USB have phantom power, both the Control Surface and the Foot Controller have power supplied via their connectors. Software drivers for major digital mixers and music editors will allow the controller function to be duplicated in virtually any environment.

The foot controller will have one continuous controller pedal, one two-dimensional continuous controller pedal, and eleven-foot switches clustered as above.

The Preamplifier 2 (the Sound Modifier):

The Master Rack Unit

The Master Rack unit is a computer taking the digital MAGIC unprocessed signals in and outputting the MAGIC processed digital signals out for distribution (routing). The Master Rack will be in a cabinet enclosure that will allow five-rack unit. The Global Amplification System will use two of these, and the other three will allow any rack-mounted units to be added.

The Master Rack enclosure is rugged with covers and replaceable Cordura TM gig bag covering. It will meet UPS size requirements and is extremely light. The three empty racks are on slide-in trays (which come with the unit) but will allow the effects devices to be removed easily, substituted and carried separately. The rack trays will make electrical contact with the motherboard unit, so that stereo input, stereo output, two-foot switch inputs, and digital input and output are available so that no connections are necessary once the effects device is docked.

The Master Rack enclosure has several unconventional features that will be highly useful for the performer/player. There are power outlets, four on each side that will allow for power to the three empty rack bays, plus others. The power outlets will allow wall plug power supplies (wall worts) both in terms of distance between outlets and allowing space for these unlikable supplies. The supplies are nested inside the enclosure (protected and unobtrusive) and will never have to be dealt with again. Loops will allow these supplies to be anchored in using simple tie wraps.

All rack units mount to a sliding plate on which they will rest. The effects devices can thus slide out and be replaced, similar to "hot swap" computer peripherals. A set of patch bay inputs and outputs is installed on the back plane, accessible via a hinged action from the backside of the Master Rack. The other side of the patch bay will be accessible from the top of the enclosure, which will be recessed and unobtrusive when not needed. All I/O to the integral Global Amplification System will be on the bay for flexible yet semi permanent set-ups.

The Global Amp rack units can also slide out for maintenance and replacement. One of the rack units is the control computer for the MAGIC system, including a "hot swappable" hard disk, a "hot swappable" CD-RW unit, and the digital processing and signal routing and control circuits. The control unit takes the digital MAGIC signals in and out and 2 USB connectors, coupled to a general purpose processing section. The processor section processes multiple digital signals intensively on a real time basis and handles all the MAGIC control functions.

The rack unit uses an internal SCSI interface to communicate with outboard storage devices. This allows not only modification of the sound, but the ability to record and store musical signals for real time play back. The unit has a built in Echoplex™, plus the ability to store large programs to load from cheap hard media. Using the SCSI protocol allows the use of hard disks, ZIP drives, CD drives, etc. to minimize use of expensive RAM.

The other rack units include a power supply and other "high voltage" relays, etc. The power supply is preferably a switching supply that can be used throughout the world. The power outlets for the rack bays are connected to a transformer, which can be switched in or out to accommodate worldwide use even for these effects.

The Master Rack will nest on top of the Base Unit/Sub Woofer and will extend from the Base via microphone type locking extension rods. Thus, the unit can be raised to a level to be easily accessed and view by the performer/player.

A 48 VDC power bus will be provided. Modules stepping this down to common voltages for non-AC boxes will be available (i.e. 12 VDC, 9 VDC). This will eliminate ground loops and heavy wall plug power supplies.

3. The Power Stage (Simple Amplification);

The major effort in amplification of a signal deals with the power supply section, particularly when the amplification is at high levels. The MAGIC system devices use conventional switching power supplies to supply standard 48 VDC. This will address issues of certification in various countries, will allow the "amplifier" to work in any country around the world, reduce weight, insure safety and increase reliability and serviceability.

4. The Speakers (Sound Modifier, Create the Sound Envelope).

The speakers have both a digital MAGIC signal and 48 VDC power input. Optionally, the speaker can have a built in power supply and thus could take AC in.

The speaker cabinet can have a built in monitoring transducer that sends information back to the Master Rack via the MAGIC Link, allowing sophisticated feedback control algorithms. Thus, with adjustments digitally on the fly by the DSP amplifier, even poor speakers can be made to sound flat or contoured to suit personal taste.

Additionally, multi-speaker arrays can be used, where individual speakers are used per guitar string in a single cabinet, giving a more spacious sound.

5. The Cabinet (Esthetics and Durability);

By "packetizing" speaker cabinets, they can be made small and scalable. In other words, the can be stacked to get increased sound levels, or even better, distributed on stage, in the studio, or throughout the performance arena. Sophisticated panning and spatialization effects can be used even in live performance. The speakers can be UPS shippable, and plane worthy.

The Universal Control Surface

Figure 3:
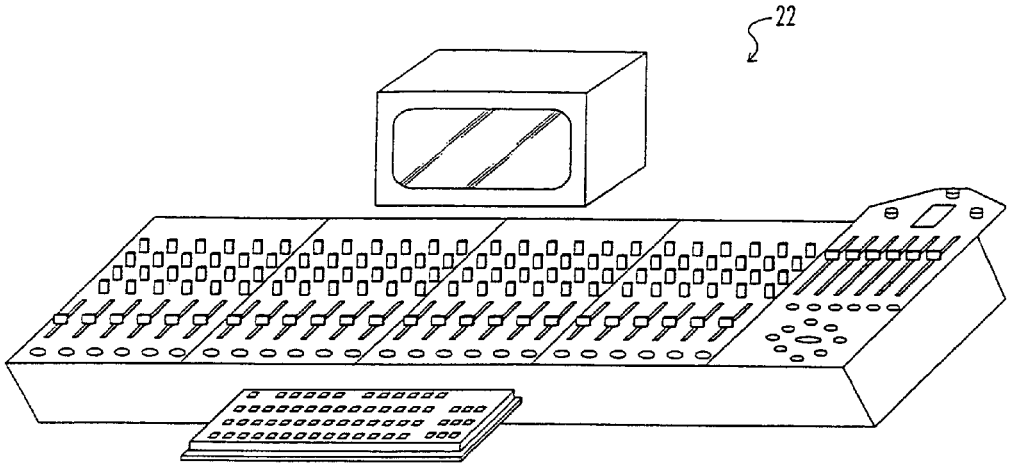
FIG. 3 is a front perspective view of a music editing control device usable in the system of this invention.

One embodiment of a universal control surface usable in the MAGIC system is shown in FIG. 3.

24 Slider Port Controls.

Each slider has LED's acting as VU meters (or reflecting other parameters) on the left of the slider. A single switch with an adjacent LED is at the bottom of the slider. Four rotary controls are at the top of each slider. Preferably, a full recording Jog Shuttle, recording type buttons, and "go to" buttons are included.

Standard control position templates can be printed or published that can be applied to the control surface for specific uses.

The control surface shown in FIG. 3 does not represent a true mixing console. The controls are simply reduced to a digital representation of the position of knobs, etc., and are then sent to a computer via USB, MIDI or MAGIC where any real work takes place, such as mixing, editing, etc. The control surface can connect via USB to a remote PC.

Thus, a system and method has been described that allows for the universal interconnection, communication and control of musical instruments and related audio components in the digital domain.

Thus, although there have been described particular embodiments of the present invention of a new and useful Universal Audio Communications and Control System and Method," it is not intended that such references be construed as limitations upon the scope of this invention except as set forth in the following claims.

What is claimed is:

1. A digital media communications and control system comprising:

a. a plurality of audio devices, each of the devices including a device interface module for communication of digital audio data and control data from at least one of the devices to at least one other of the devices;

b. a universal data link operatively connected to each of the device interface modules;

c. the device interface modules and universal data links are operative in combination to connect the devices together in the system and provide full duplex communication of the digital audio data and control data between the devices; and d. wherein each data link includes a conventional CAT5 network cable terminated by conventional RJ-45 connectors.

2. The system of claim 1 wherein each data link comprises one and only one of said CAT5 network cables connecting a pair of the devices.

3. The system of claim 1 further comprising a network hub and wherein at least some of the data links comprise said CAT5 network cables connecting the device interface modules to the hub in a network topology whereby the digital audio data and control data that are communicated over the data links are accessible by each of the devices linked to the hub without having a direct connection between devices.

4. The system of claim 1 wherein each CAT5 network cable includes four twisted wire pairs, two of said pairs carrying phantom power to the devices.

5. The system of either of claim 1 wherein the audio devices comprise audio transducer devices, the transducer devices including one or more devices selected from a group comprising musical instruments, microphones, headphones, audio speakers, and audio recording devices.

6. The system of claim 5 wherein the audio devices further comprise audio controller devices, the controller devices including one or more devices selected from a group comprising audio amplifiers and system control devices.

7. The system of claim 3 wherein the device interface modules are operative to direct digital audio signals and control signal generated by a source audio device to one or more target audio devices connected to the system.

8. The system of claim 7 wherein the target devices are changeable by a user while the source and target audio devices are actively connected to the system.

9. The system of claim 1 wherein functions performed by one of the audio devices can be shared by more than one of the other devices connected to the system.

10. The system of claim 1 wherein the audio and control data are in big endian order.

11. The system of claim 1 wherein the control data includes Message In Progress (MIP) and Clear To Send (CTS) bits to allow the audio devices receiving the data to manage control packet buffer space.

12. The system of claim 6, wherein:

each CAT5 network cable includes four wire pairs, two of said pairs being dedicated to carrying said digital audio data and control data;

each of said audio transducer devices includes an RJ-45 jack wired in a type A configuration;

each of said audio controller devices includes an RJ-45 jack wired in a type B configuration; and wherein the type A and B configurations provide a cross-over function so that data transmitted from each audio transducer device may be received by one of the audio controller devices.

13. A digital media communications and control system comprising:

a. a plurality of audio devices, each of the devices including a device interface module for communication of digital audio data and control data from at least one of the devices to at least one other of the devices;

b. a universal data link operatively connected to each of the device interface modules;

c. the device interface modules and universal data links are operative in combination to connect the devices together in the system and provide full duplex communication of the digital audio data and control data between the devices; and d. wherein the audio and control data are in big endian order.

14. A digital media communications and control system comprising:

a. a plurality of audio devices, each of the devices including a device interface module for communication of digital audio data and control data from at least one of the devices to at least one other of the devices;

b. a universal data link operatively connected to each of the device interface modules;

c. the device interface modules and universal data links are operative in combination to connect the devices together in the system and provide full duplex communication of the digital audio data and control data between the devices; and d. wherein the control data includes Message in Progress (MTP) and Clear To Send (CTS) bits to allow the audio devices receiving the data to manage control packet buffer space.

* * * * *